US011142946B2

(12) United States Patent
McNabb et al.

(10) Patent No.: US 11,142,946 B2
(45) Date of Patent: Oct. 12, 2021

(54) ROLLER-SHUTTER DOOR SYSTEM

(71) Applicant: Innomotive Solutions Group Inc., Burlington (CA)

(72) Inventors: Oran McNabb, Jordan (CA); Gary Billings, Lomira, WI (US); Jaimin Shah, Brampton (CA); Bruce Whitehouse, Milton (CA)

(73) Assignee: INNOMOTIVE SOLUTIONS GROUP INC., Burlington, CA (US)

( * ) Notice: Subject to any disclaimer, the term of this patent is extended or adjusted under 35 U.S.C. 154(b) by 368 days.

(21) Appl. No.: 15/835,445

(22) Filed: Dec. 7, 2017

(65) Prior Publication Data

US 2019/0178032 A1 Jun. 13, 2019

(51) Int. Cl.

| | |
|---|---|
| ***E06B 9/15*** | (2006.01) |
| ***E06B 9/17*** | (2006.01) |
| ***E06B 9/58*** | (2006.01) |

(52) U.S. Cl.

CPC ..... *E06B 9/581* (2013.01); *E06B 9/15* (2013.01); *E06B 9/17076* (2013.01); *E06B 9/582* (2013.01); *E06B 2009/1511* (2013.01); *E06B 2009/1544* (2013.01); *E06B 2009/1583* (2013.01)

(58) Field of Classification Search

CPC ..... E06B 9/17076; E06B 2009/588; E06B 9/582; E06B 2009/1577; E06B 2009/1583; E06B 9/581; E06B 2009/15; E06B 2009/1544; E06B 2009/1511; E06B 2009/1538; E06B 2009/1533; E06B 2009/005; E06B 9/15; E06B 9/70

See application file for complete search history.

(56) References Cited

U.S. PATENT DOCUMENTS

| | | | | |
|---|---|---|---|---|
| 949,789 | A * | 2/1910 | Wilson et al. | E06B 9/15 160/235 |
| 5,246,054 | A * | 9/1993 | Shepherd | E06B 9/17046 160/133 |
| 2005/0211398 | A1* | 9/2005 | Coenraets | E06B 9/581 160/271 |
| 2007/0193148 | A1* | 8/2007 | Simko | E06B 1/705 52/300 |
| 2008/0196842 | A1* | 8/2008 | Schoeren | E06B 9/581 160/133 |

(Continued)

*Primary Examiner* — Daniel P Cahn

(74) *Attorney, Agent, or Firm* — Steven M. Greenberg, Esq.; Shutts & Bowen LLP

(57) ABSTRACT

A roller-shutter door system comprises a pair of opposed substantially parallel guide rails and a door formed by longitudinally hinged door slats coupled to a retraction roller. The door can be opened and closed with rotation of the retraction roller, and longitudinal ends of the door slats ride within door guide channels in the guide rails. Exterior side seals may cover a gap between the door slats and the door guide channels, and wear shields may be interposed between coated exterior surfaces of the door slats and the side seals so that the side seals bear on the wear shields instead of the coated exterior surfaces. The guide rails may have equipment channels on interior sides thereof, and radius guides may be releasably received in open superior ends of the equipment channels. The radius guides have outwardly facing guide surfaces to guide the door slats toward the retraction roller.

16 Claims, 25 Drawing Sheets

(56) References Cited

U.S. PATENT DOCUMENTS

| | | | | |
|---|---|---|---|---|
| 2009/0266931 | A1* | 10/2009 | Gottschalk | E06B 9/17 242/599 |
| 2011/0018205 | A1* | 1/2011 | Nelson | E06B 9/582 277/315 |
| 2012/0255687 | A1* | 10/2012 | Komatsu | E06B 9/13 160/310 |
| 2013/0306252 | A1* | 11/2013 | Lambridis | E06B 9/13 160/133 |
| 2015/0096696 | A1* | 4/2015 | Sentjurc | E06B 9/17076 160/309 |
| 2015/0361715 | A1* | 12/2015 | Frede | E06B 9/60 160/133 |
| 2016/0031305 | A1* | 2/2016 | Bernardo | B60J 7/085 296/100.03 |
| 2017/0067285 | A1* | 3/2017 | Lambridis | E06B 9/15 |
| 2017/0101818 | A1* | 4/2017 | Frede | E06B 9/15 |
| 2017/0138118 | A1* | 5/2017 | Wong | E06B 5/16 |
| 2017/0356239 | A1* | 12/2017 | Ouyang | E06B 9/582 |
| 2018/0258689 | A1* | 9/2018 | Rejc | E05D 15/242 |
| 2019/0048658 | A1* | 2/2019 | Garcia Hernandez | E06B 9/44 |
| 2019/0390511 | A1* | 12/2019 | Lambridis | E06B 9/70 |
| 2020/0011131 | A1* | 1/2020 | Bonge, Jr. | E06B 7/32 |

* cited by examiner

ROLLER-SHUTTER DOOR SYSTEM

TECHNICAL FIELD

The present disclosure relates to roller-shutter door systems.

BACKGROUND

Roller-shutter doors systems comprise a door formed from a plurality of long, narrow door slats that are longitudinally hingedly coupled to one another, with a superior end of the roller-shutter door being coupled to a retraction roller and longitudinal ends of the door slats riding along door guide channels. The roller-shutter door can be opened by rolling it onto the retraction roller and closed by unrolling it from the retraction roller. Roller-shutter doors are used in a wide variety of applications, with one common application being as doors for the equipment compartments on the sides of firefighting vehicles, colloquially known as "fire trucks".

To prevent the ingress of dirt, grit and other detritus, roller-shutter door systems are typically provided with seals to cover the gap between the door slats and door guide channels. Because the seals bear on the exterior surfaces of the door slats, over time, as the door is repeatedly opened and closed, the paint, anodization, powder coat or other surface coating can be worn away.

The guide rails in which the door guide channels are formed often also include equipment channels, usually disposed on interior sides thereof, relative to the roller-shutter door. Components such as door-ajar sensors, LED lighting strips, and the like can be placed inside the equipment channels during assembly of the roller-shutter door system. The guide rails are usually made from metal, and typically include at their superior ends a region where part of the guide rail is cut away and a portion of the guide rail is curved inwardly to provide a guide surface to guide the slats toward the retraction roller. This portion typically curves over the superior end of the equipment channel. Since the inferior end of the equipment channel usually abuts the floor of the compartment with which the roller-shutter door system is used, the bent portion of the guide rail used to form the curved guide surface can make it difficult or impossible to remove components from the equipment channels to provide field service or replacement if such components should fail.

SUMMARY

In one aspect, the present disclosure is directed to a roller-shutter door system which includes sacrificial wear shields to inhibit coat wear.

One exemplary roller-shutter door system comprises a frame including a pair of opposed substantially parallel guide rails and a roller-shutter door comprising a plurality of door slats having coated exterior surfaces. The door slats are longitudinally hingedly coupled to one another to form the roller-shutter door. A retraction roller is carried by the frame so as to be rotatable relative to the frame about an axis of rotation substantially longitudinally parallel to the door slats, and a superior end of the roller-shutter door is coupled to the retraction roller. The roller-shutter door can be opened by rolling onto the retraction roller with rotation of the retraction roller in a first direction and closed by unrolling from the retraction roller with rotation of the retraction roller in a second direction opposite the first direction. Longitudinal ends of the door slats are received within and ride along door guide channels in the guide rails, and a pair of exterior side seals is carried by the frame and extend along the guide rails. Each of the exterior side seals projects over the respective guide rail and the longitudinal ends of the door slats to cover a gap between the door slats and the door guide channels. Each door slat carries a sacrificial wear shield at each longitudinal end thereof, with the wear shields being interposed between the coated exterior surfaces of the door slats and the side seals whereby the side seals bear on the wear shields instead of on the coated exterior surfaces of the door slats.

In one embodiment, the door slats comprise main body members and end shoes secured at longitudinal ends of the main body members. The end shoes form the longitudinal ends of the door slats and the wear shields are carried by the end shoes. The wear shields may be projections formed monolithically as part of the end shoes. In one such embodiment, the end shoes each comprise a cap and a releasable latching mechanism depending from the cap and each wear shield is a spacer interposed between the cap and the latching mechanism. In another such embodiment, the end shoes each comprise a cap and a releasable latching mechanism depending from the cap and each wear shield depends from the cap alongside the latching mechanism in overlapping relation therewith.

In other embodiments, the wear shields are separate and distinct parts from the end shoes and are trapped between the end shoes and the main body members.

In another aspect, the present disclosure is directed to a roller-shutter door system which includes releasable radius guides to facilitate in-field servicing of components disposed in an equipment channel.

In one embodiment, a roller-shutter door system comprises a frame including a pair of opposed substantially parallel guide rails and a roller-shutter door. The roller-shutter door comprises a plurality of door slats that are longitudinally hingedly coupled to one another to form the roller-shutter door, and a retraction roller is carried by the frame so as to be rotatable relative to the frame about an axis of rotation substantially longitudinally parallel to the door slats. A superior end of the roller-shutter door is coupled to the retraction roller whereby the roller-shutter door can be opened by rolling onto the retraction roller with rotation of the retraction roller in a first direction and closed by unrolling from the retraction roller with rotation of the retraction roller in a second direction opposite the first direction. Longitudinal ends of the door slats are received within and ride along door guide channels in the guide rails, and the guide rails have equipment channels disposed on interior sides thereof, relative to the roller-shutter door. A radius guide is releasably received in an open superior end of each equipment channel. The radius guides each have an outwardly facing guide surface that curves inwardly and superiorly to guide the door slats toward the retraction roller.

In a particular embodiment, at least one substantially rigid component is disposed in at least one of the equipment channels, and the vertical clearance above the superior end of the respective equipment channel when the radius guide is removed from the superior end of the respective equipment channel exceeds the length of the substantially rigid component(s) to permit withdrawal of the component(s) by sliding the component(s) out of the open superior end of the respective equipment channel.

Some embodiments may combine both the sacrificial wear shields and the releasable radius guides.

BRIEF DESCRIPTION OF THE DRAWINGS

These and other features will become more apparent from the following description in which reference is made to the appended drawings wherein.

DETAILED DESCRIPTION

Figure 1:
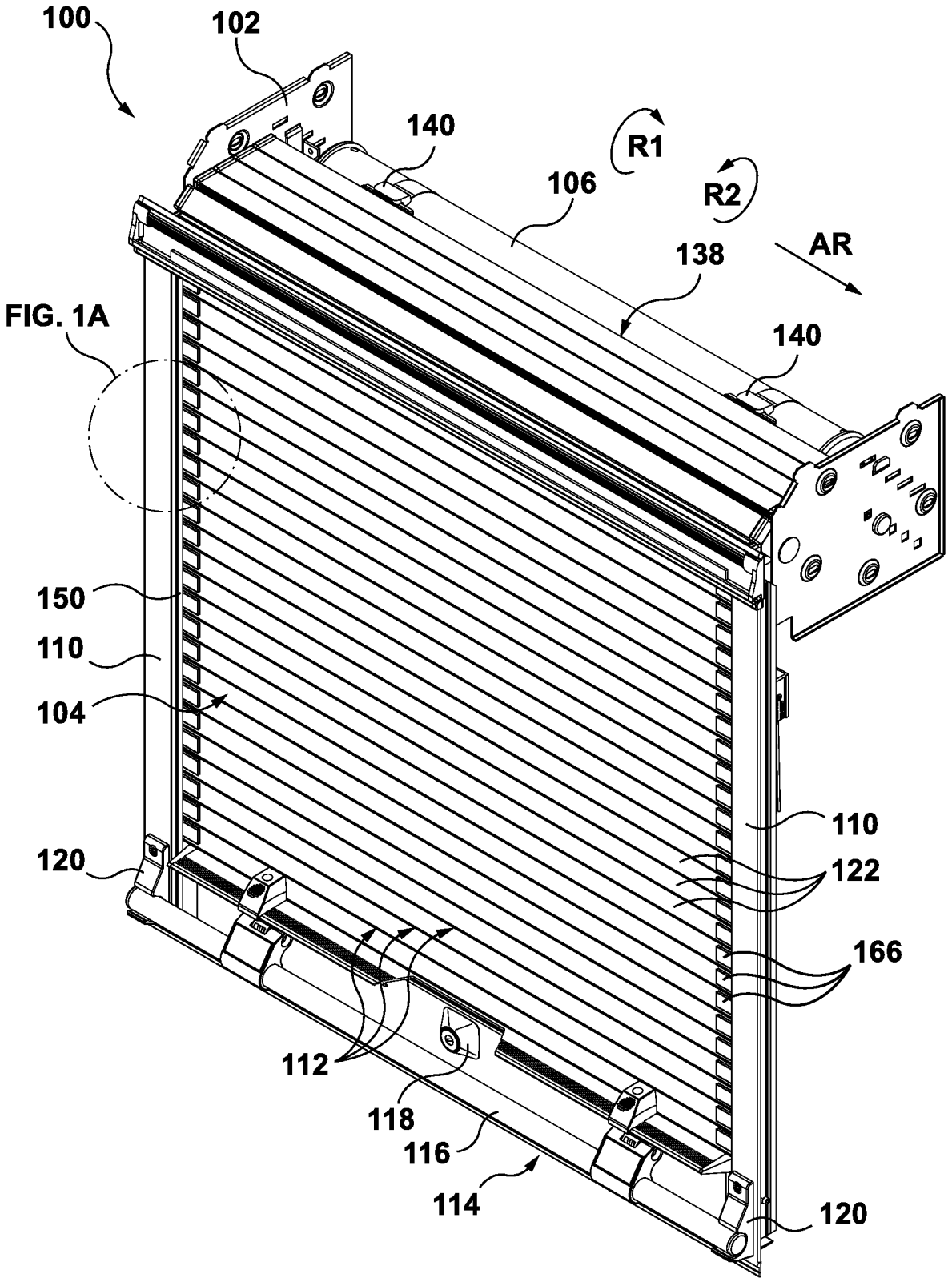
FIG. 1 is a top front perspective view of an exemplary roller-shutter door system according to an aspect of the present disclosure.
Figure 1A:
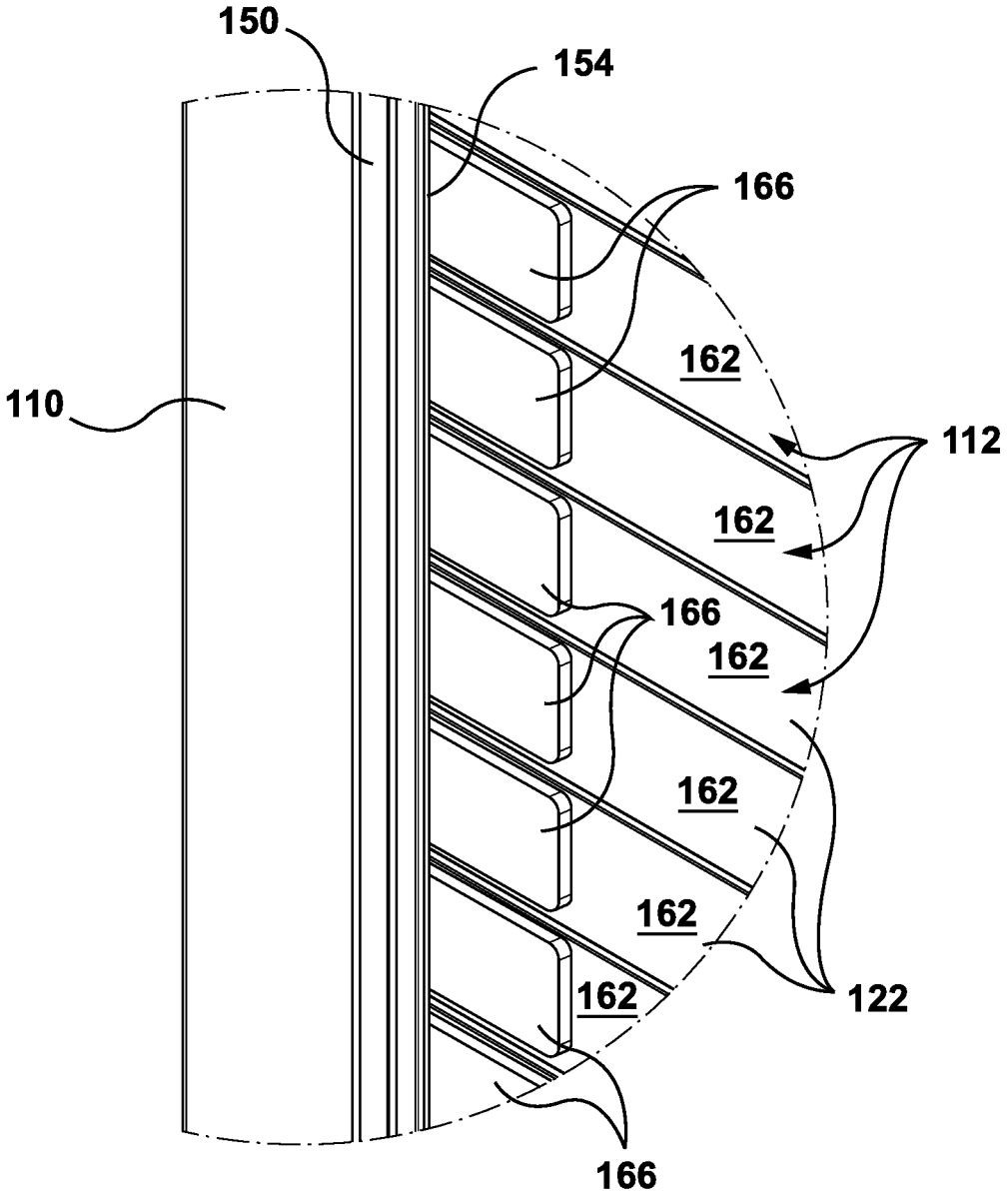
FIG. 1A is a detailed view of a portion of the roller-shutter door system shown in FIG. 1.

Reference is first made to FIG. 1, which shows an exemplary roller-shutter door system, denoted generally by reference 100, according to an aspect of the present disclosure. The roller-shutter door system 100 comprises a frame 102, a roller-shutter door 104 and a retraction roller 106. The frame 102 may comprise a pair of opposed mounting plates, and includes a pair of opposed substantially parallel guide rails 110, and would typically be installed in or integrally constructed as part of a compartment to be closed by the roller-shutter door 104. The roller-shutter door 104 comprises a plurality of externally coated door slats 112 that are longitudinally hingedly coupled to one another so that each door slat 112 can pivot relative to each adjacent door slat 112, and an inferior terminal assembly 114 coupled to the lowermost door slat 112. The inferior terminal assembly 114 includes a pivotally-mounted, longitudinally-extending lift bar 116 to assist in opening and closing the roller-shutter door 104, and a locking mechanism 118 that cooperates with the frame 102, or the compartment being closed by the roller-shutter door 104, to secure the roller-shutter door 104 in a closed configuration. Strikers 120 carried by the guide rails 110 at inferior ends thereof support the lift bar 116 from below and releasably secure the lift-bar 116 when the roller-shutter door 104 is in the closed configuration. Flexible belts 121 extending transversely to the door slats 112 may be secured on the interior surface of the roller shutter door 114 to provide traction against the retraction roller 106 and/or the idler roller 190 (see FIG. 4B).

Figure 2B:
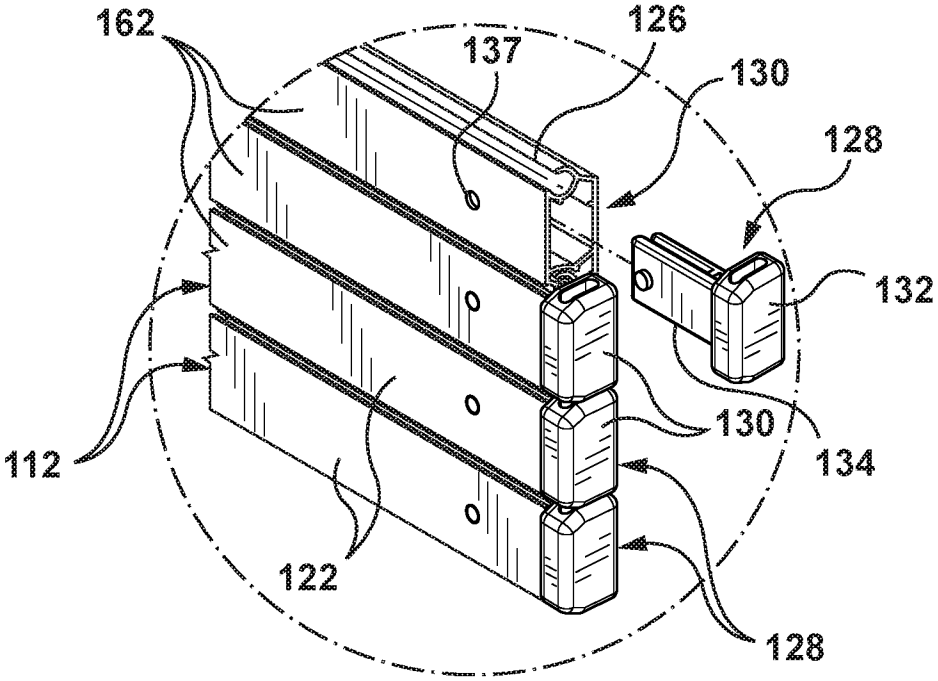
FIG. 2B is a perspective view showing coupling of end caps to main body members of door slats.
Figure 2A:
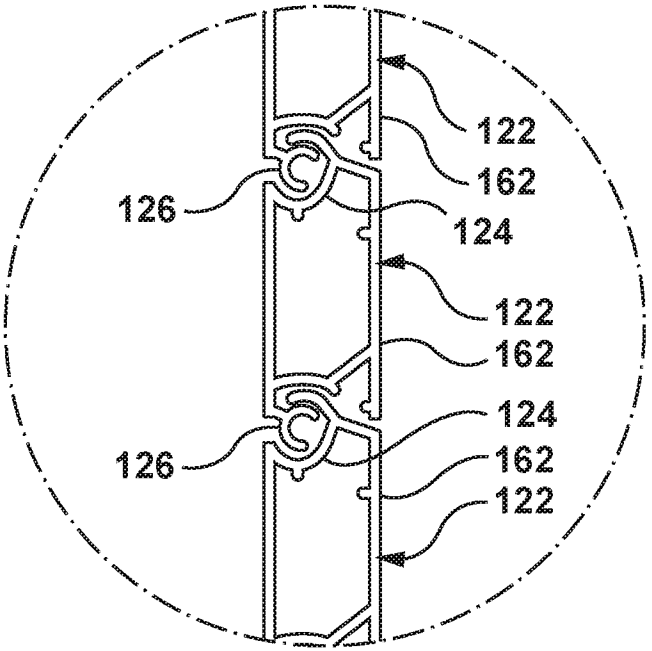
FIG. 2A is a side cross-sectional view showing hinging of door slats to one another.

Referring now to FIGS. 2A and 2B, in the illustrated embodiment, the door slats 112 are directly hinged to one another by way of a driven ball and socket design acting as a structural hinge. As shown in FIG. 2A, each of the door slats 112 comprises a hollow, open-ended main body member 122 having an elongate longitudinally-extending C-shaped knuckle 124 at its superior edge and an elongate longitudinally-extending C-shaped pin 126 depending from its inferior end. The pin 126 of one main body member 122 can be slid longitudinally into the knuckle 124 of another main body member 122 to hinge the two main body members 122 together, and end shoes 128 are then secured at the longitudinal ends 130 of the main body members 122 so that the end shoes 128 form the longitudinal ends of the door slats 112 and can pivot relative to one another along with the respective door slats 112. The end shoes 128 cover the knuckles 124 and pins 126 to secure the main body members 122, and therefore secure the door slats 112, in hinged relation to one another. In the illustrated embodiment, as shown in FIG. 2B and as will be described further below, the end shoes 128 each comprise a cap 132 and a releasable latching mechanism 134 depending from the cap 132. The latching mechanism 134 of each end shoe 128 is inserted into the open longitudinal end 130 of one of the main body members 122 and releasably latched in place with its cap 132 covering the knuckles 124 and pins 126. Because the end shoes 128 are releasably latched to the main body members 122, they can be disengaged therefrom, enabling the main body members 122 to be slid apart to facilitate replacement of a damaged door slat 112. The above description represents merely one exemplary hinging arrangement, and the door slats can be hingedly coupled to one another, directly or with intervening parts, using any suitable technique.

FIGS. 5A through 5H show various views of an exemplary end shoe 128 to illustrate the exemplary latching mechanism 134. In the illustrated embodiment, the latching mechanism 134 comprises a bracing arm 129 and a locking arm 131 which are parallel to and spaced from one another, and joined by a crossbar 133 located toward the cap 132. A cylindrical detent 135 projects outwardly from the locking arm 131. To install the end shoe 128, the distal ends of the bracing arm 129 and the locking arm 131 (i.e. the ends distal from the cap 132) are pressed together and inserted into an open end of a main body member 122 until the detent 135 reaches a correspondingly-shaped retaining aperture 137 (FIG. 2B) in the main body member 122. The detent 135 snaps into the retaining aperture 137 to secure the end shoe 128 in the main body member 122. The end shoe 128 can be released from the main body member 122 by pushing the detent 135 inwardly through the retaining aperture 137, for example with a screwdriver or other suitable tool, and then sliding the end shoe 128 outwardly. The exemplary latching mechanisms 134 shown and described represents merely one exemplary method for securing the end shoes 128 at the longitudinal ends 130 of the main body members 122, and other suitable techniques may also be used without departing from the scope of the present disclosure.

Figure 3:
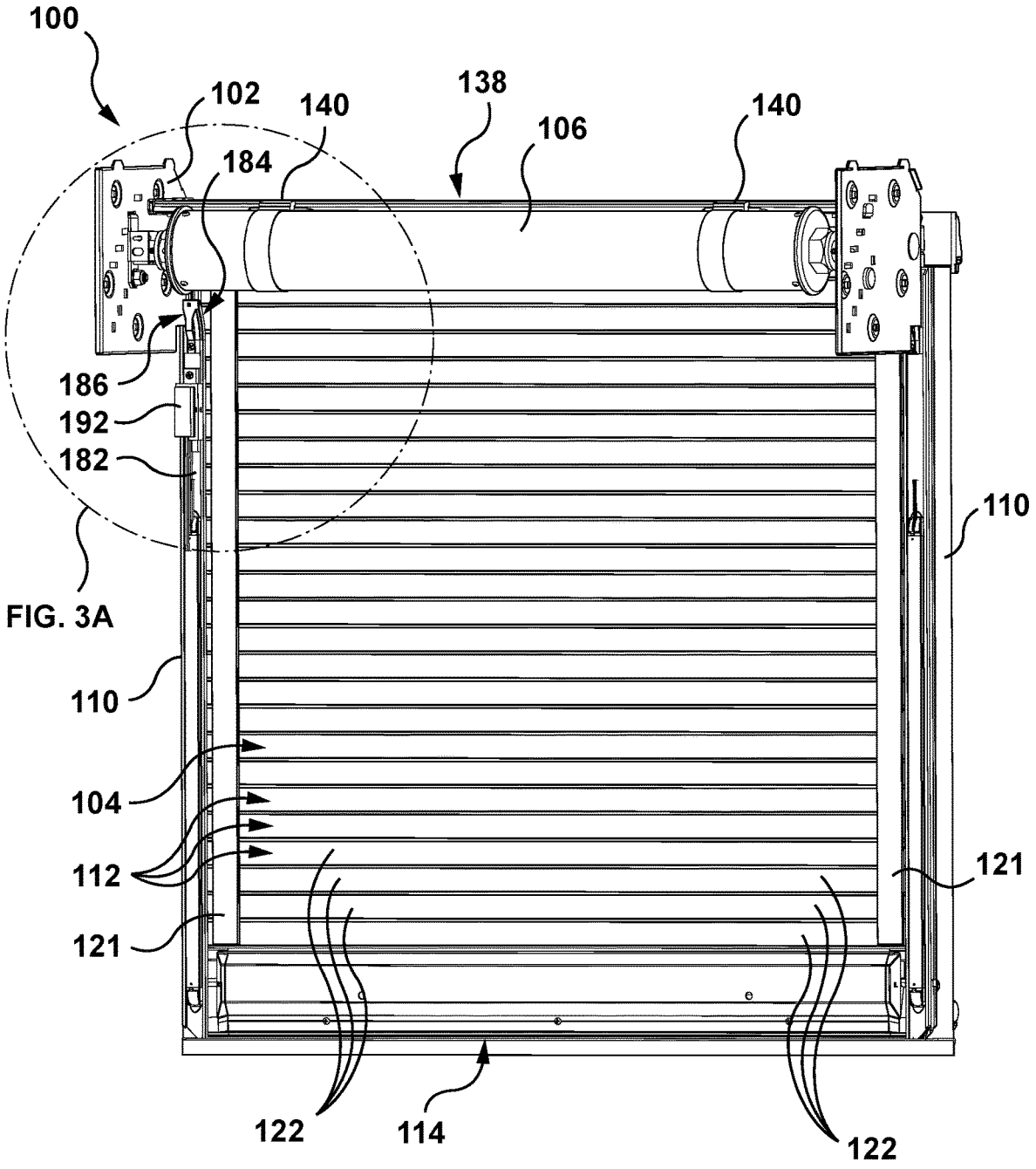
FIG. 3 is a rear perspective view of the exemplary roller-shutter door system of FIG. 1.
Figure 3A:
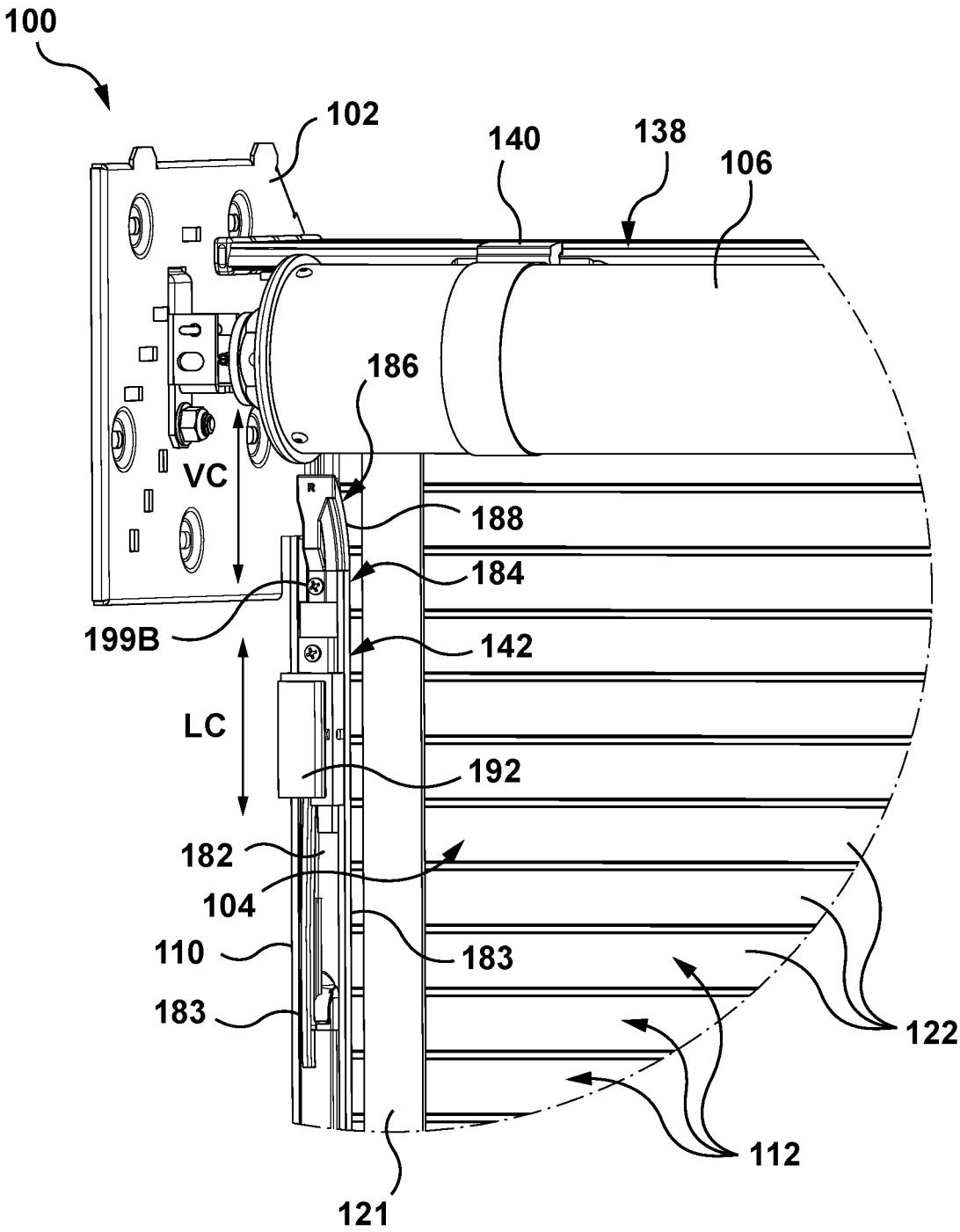
FIG. 3A is a detailed view of a portion of the roller-shutter door system shown in FIG. 3.
Figure 4:
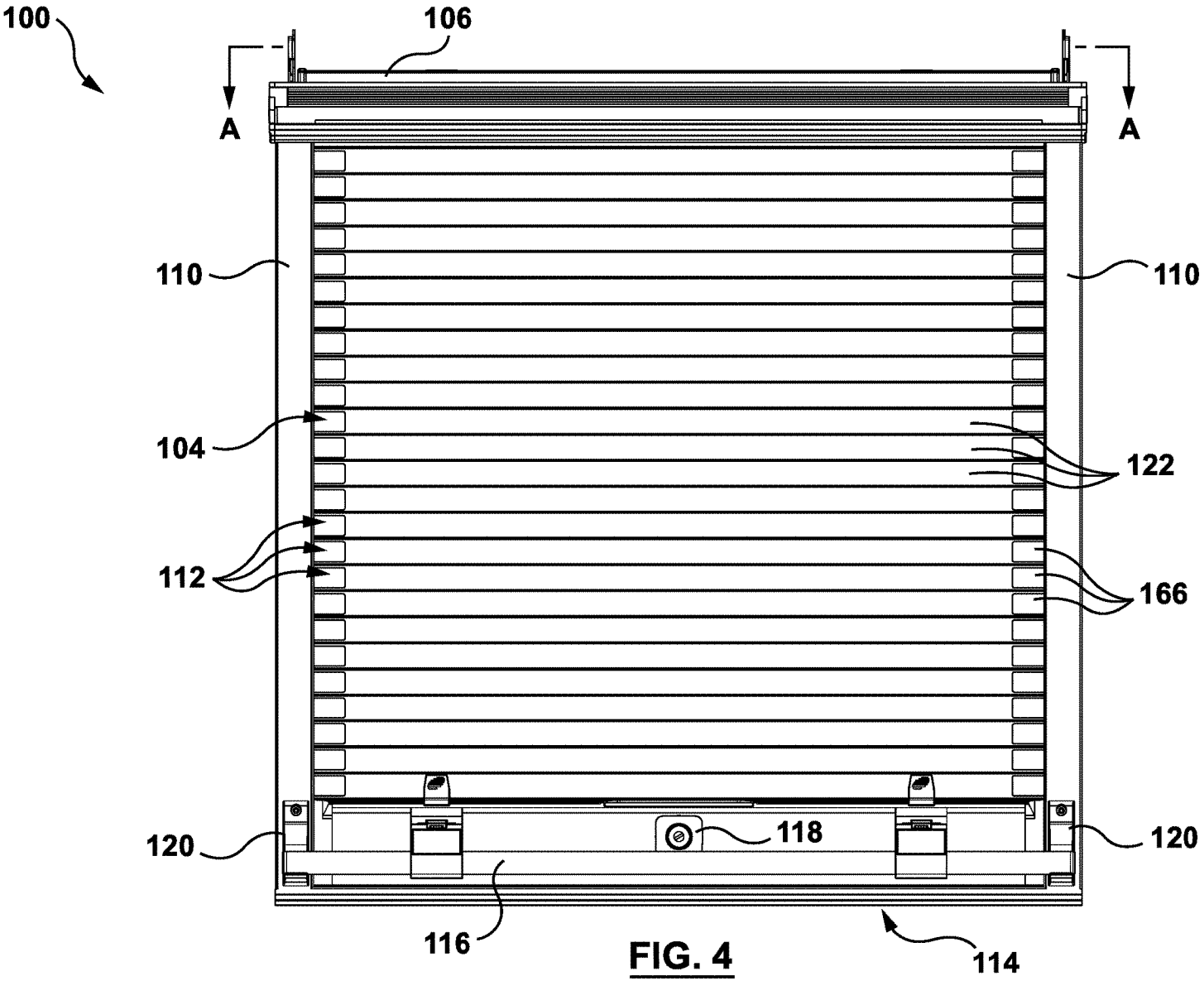
FIG. 4 is a front view of the exemplary roller-shutter door system of FIG. 1.
Figure 4A:
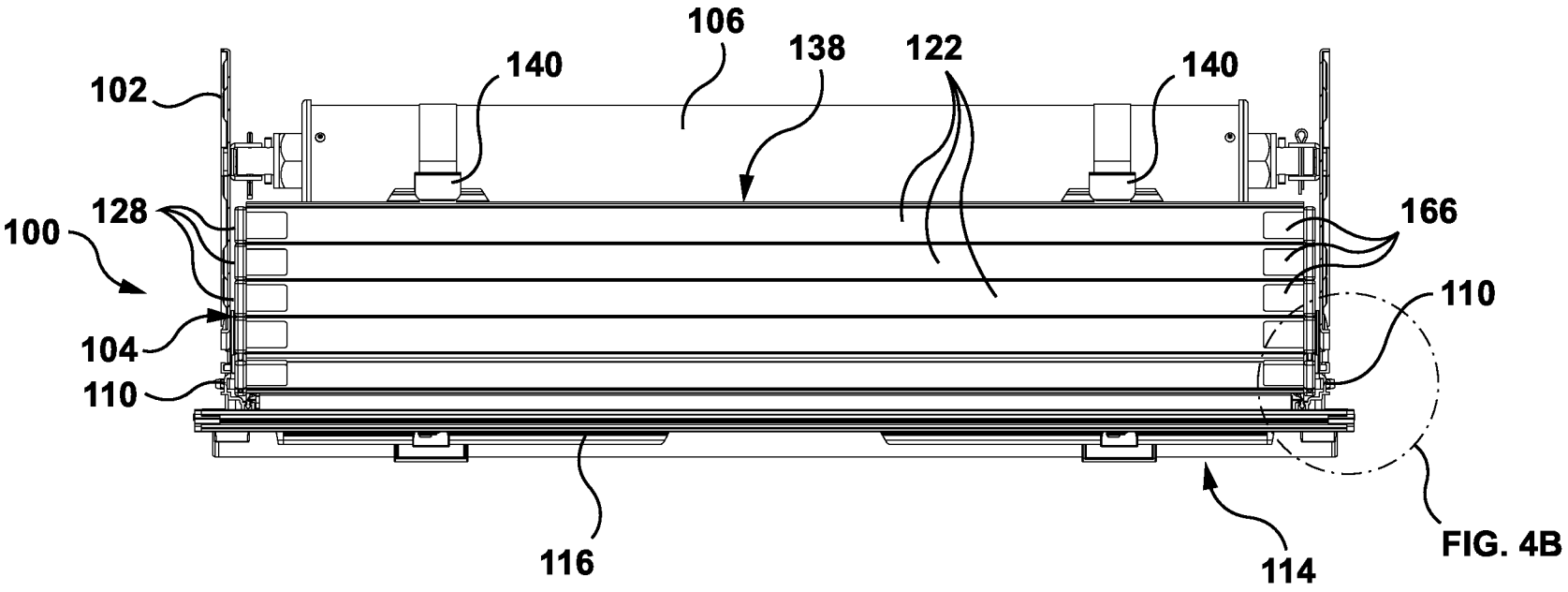
FIG. 4A is a cross-sectional view taken along the line A-A in FIG. 4.
Figure 4B:
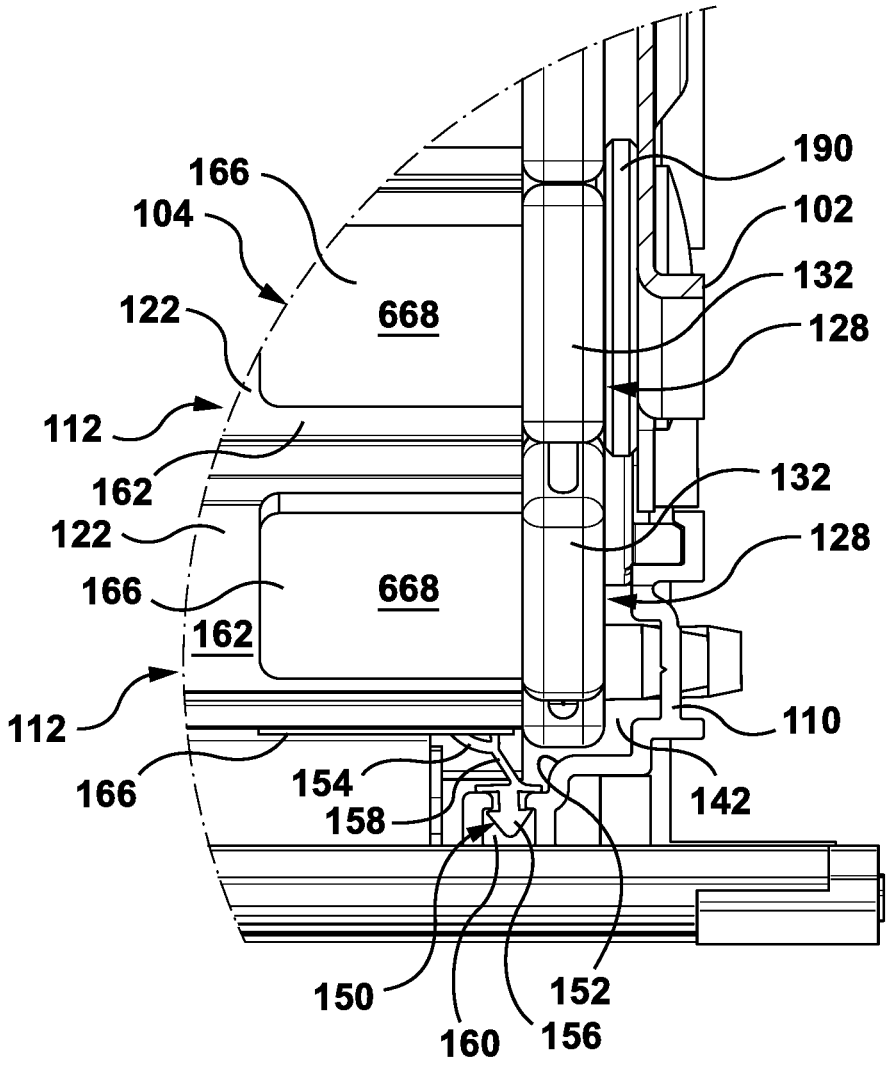
FIG. 4B is a detailed view of a portion of the roller-shutter door system shown in FIG. 4A.
Figure 5B:
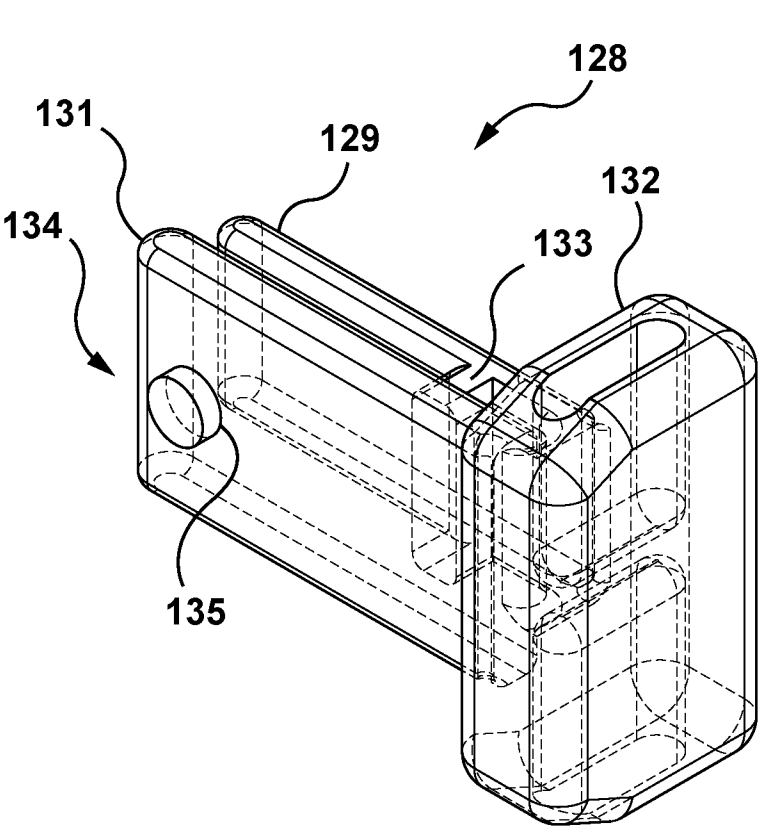
FIG. 5B is a top rear perspective view of the end shoe of FIG. 5A.
Figure 5A:
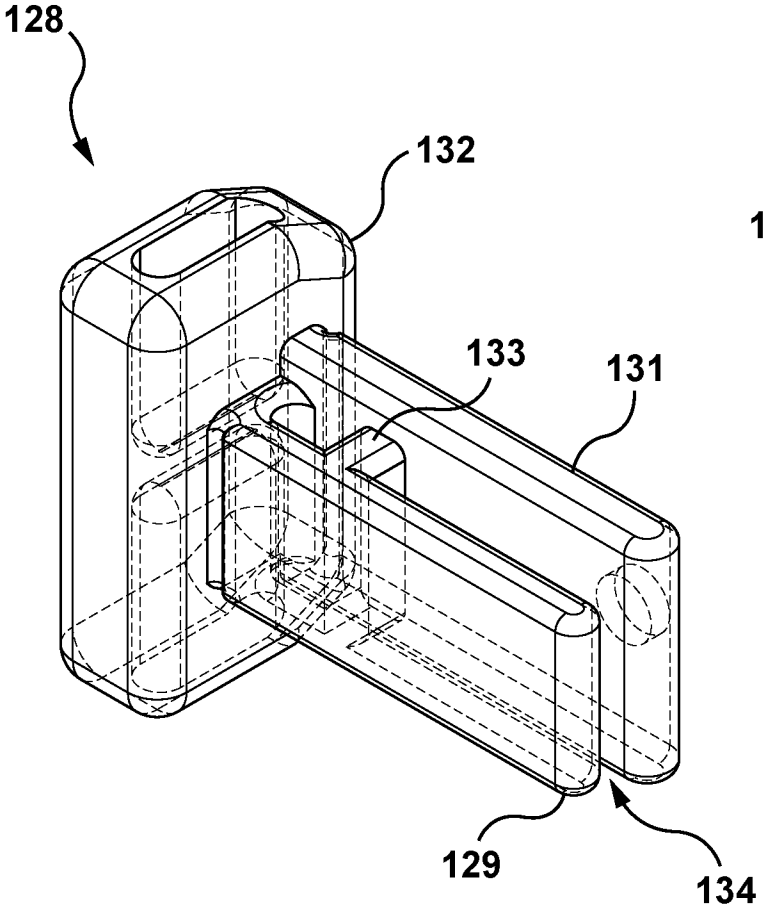
FIG. 5A is a top front perspective view of a first exemplary end shoe according to an aspect of the present disclosure.
Figure 5D:
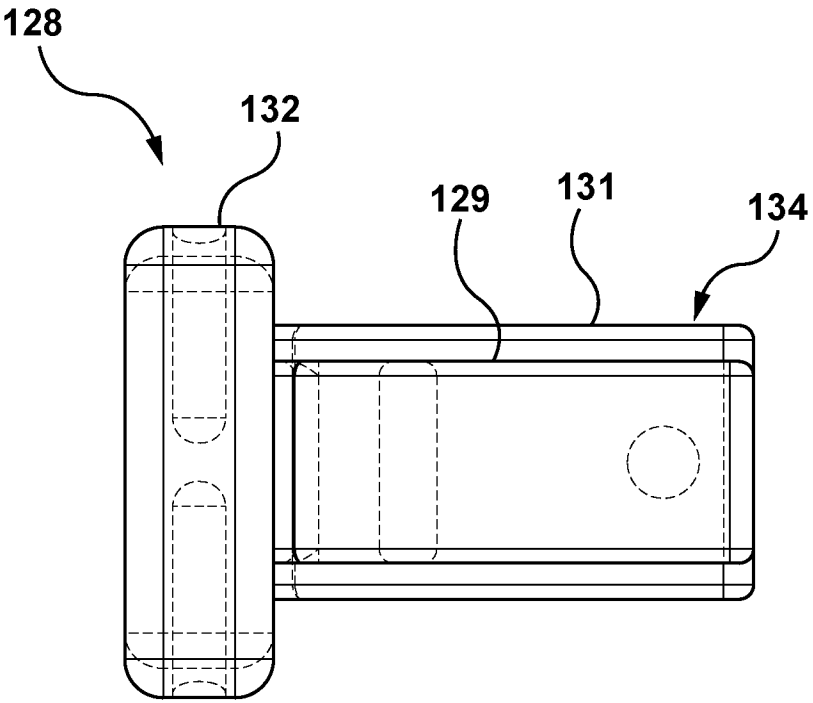
FIG. 5D is a front elevation view of the end shoe of FIG. 5A.
Figure 5C:
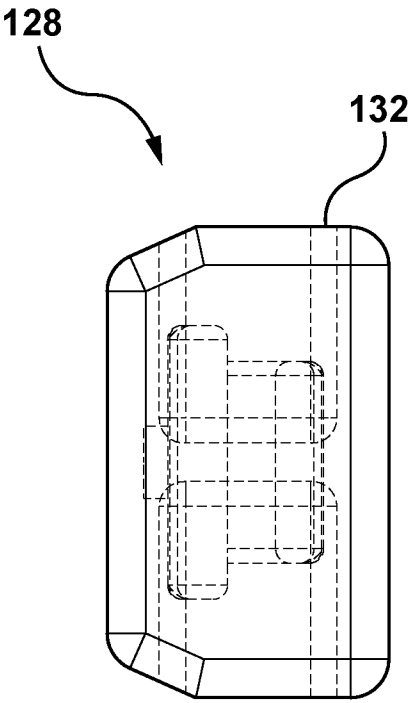
FIG. 5C is a left side elevation view of the end shoe of FIG. 5A.
Figure 5F:
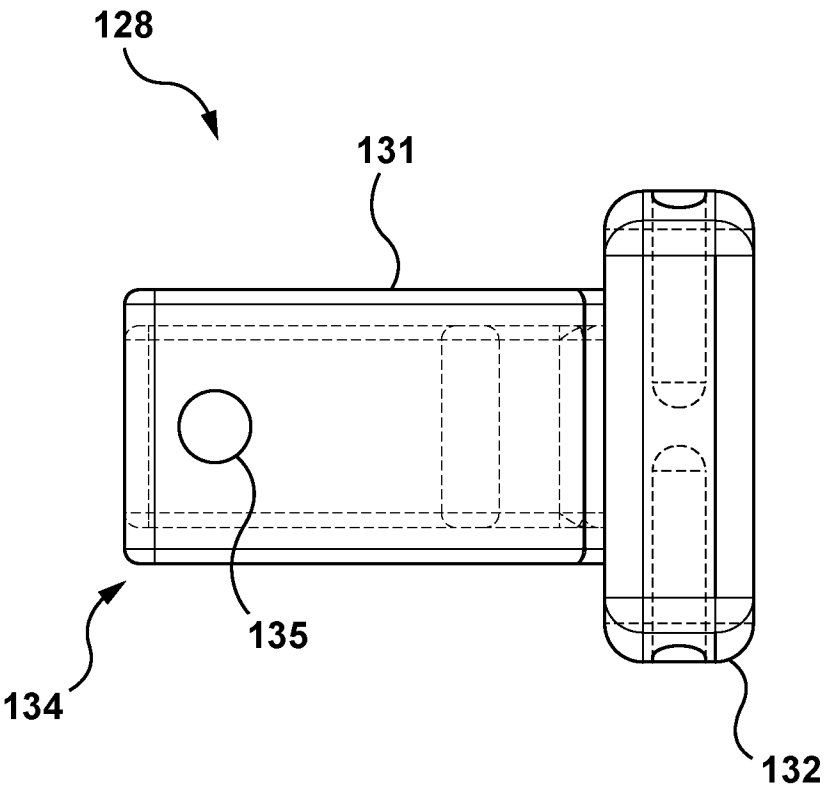
FIG. 5F is a rear elevation view of the end shoe of FIG. 5A.
Figure 5E:
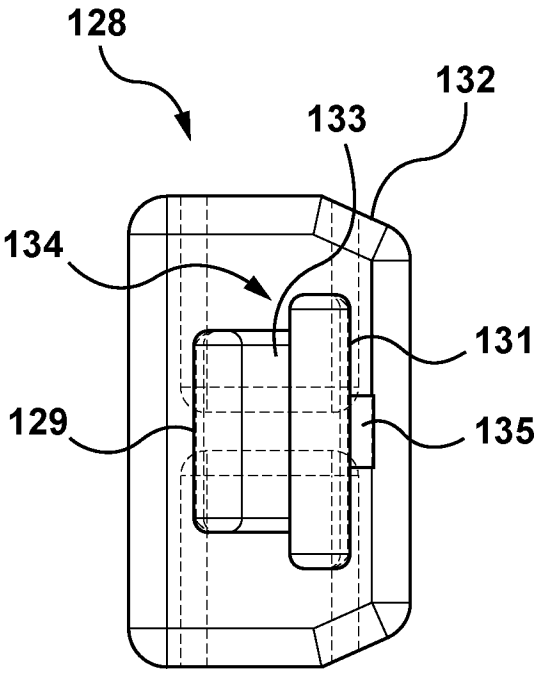
FIG. 5E is a right side elevation view of the end shoe of FIG. 5A.
Figure 5G:
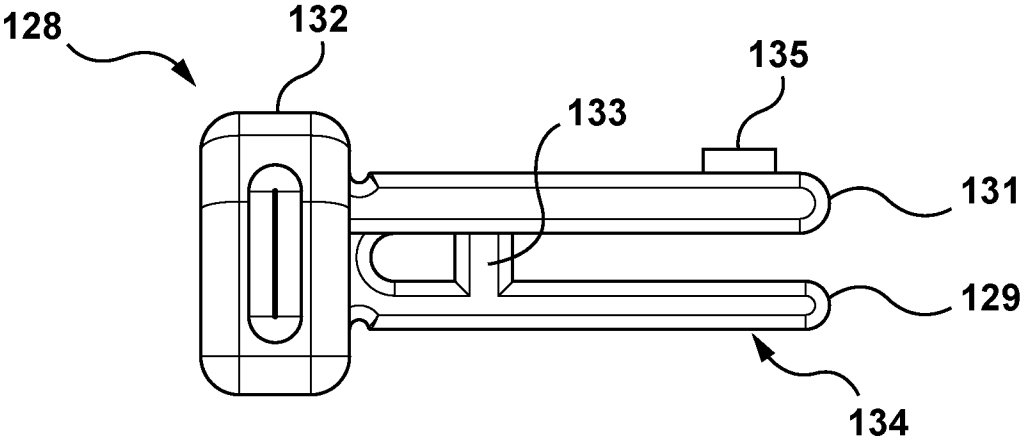
FIG. 5G is a top plan view of the end shoe of FIG. 5A.
Figure 5H:
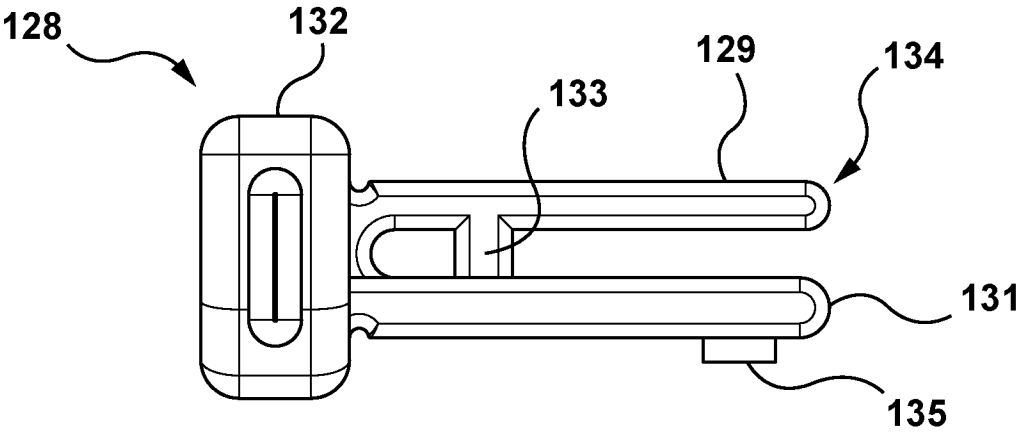
FIG. 5H is a bottom plan view of the end shoe of FIG. 5A.
Figure 6B:
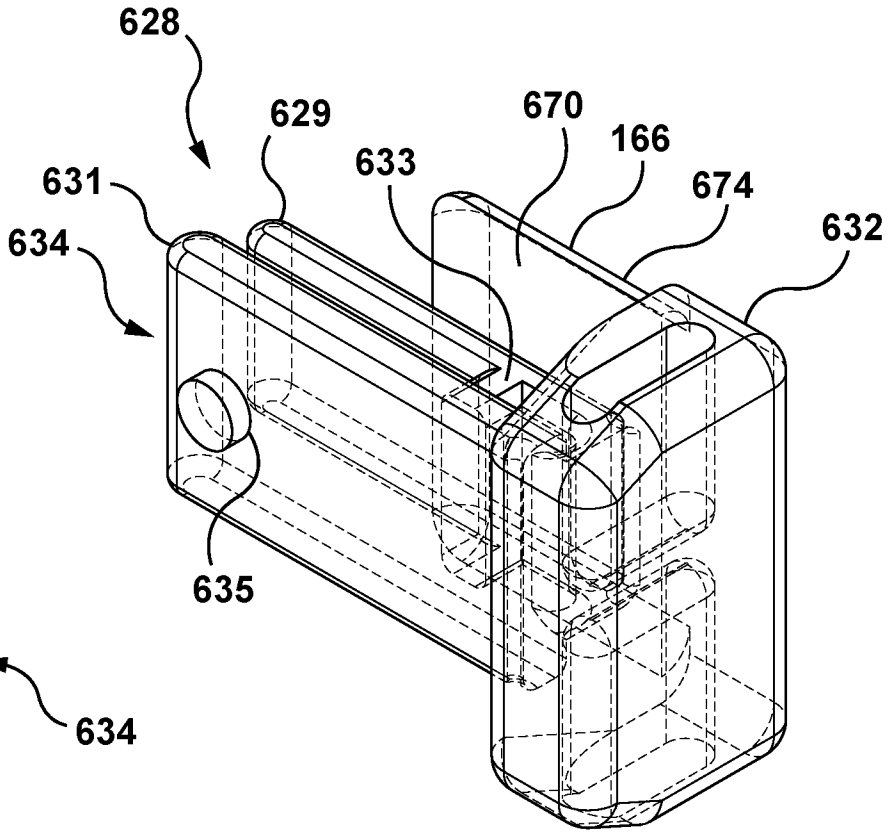
FIG. 6B is a top rear perspective view of the end shoe of FIG. 6A.
Figure 6A:
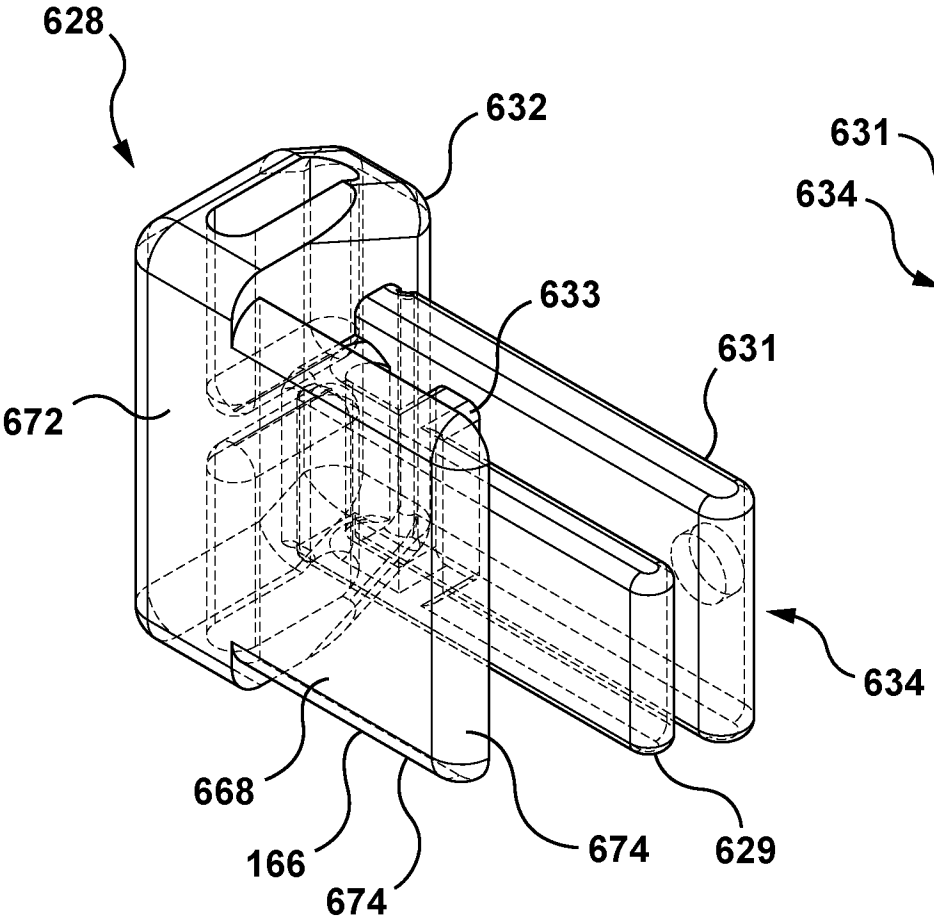
FIG. 6A is a top front perspective view of a second exemplary end shoe according to an aspect of the present disclosure.
Figure 6D:
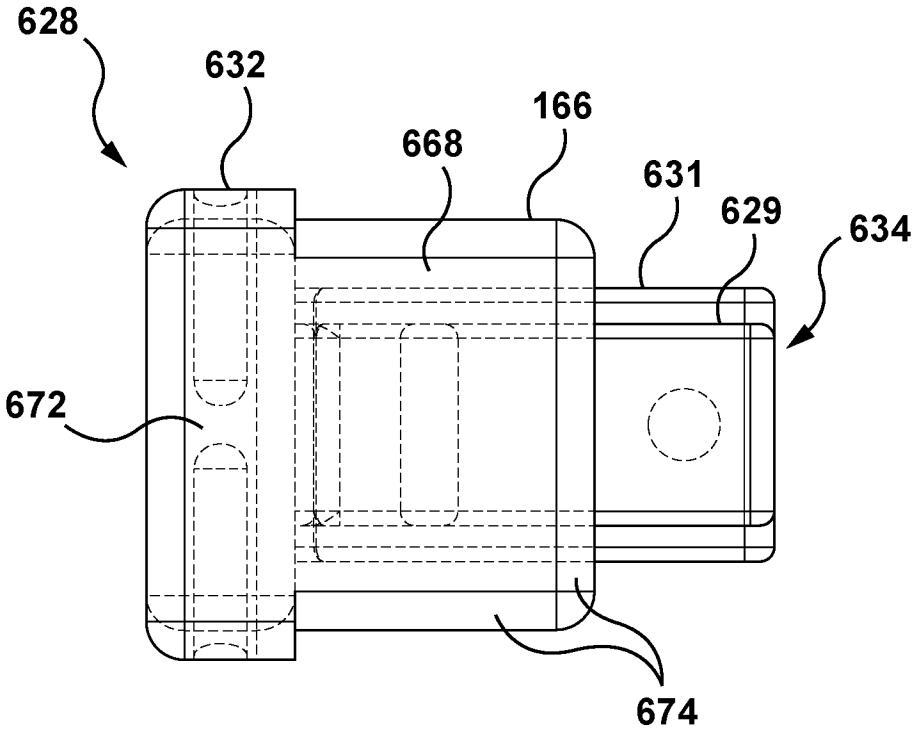
FIG. 6D is a front elevation view of the end shoe of FIG. 6A.
Figure 6C:
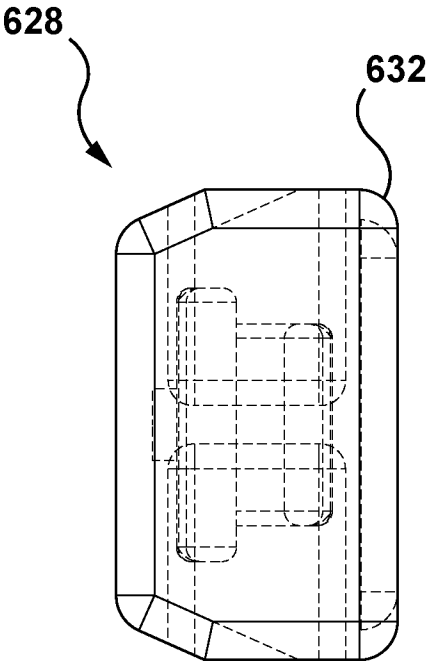
FIG. 6C is a left side elevation view of the end shoe of FIG. 6A.
Figure 6F:
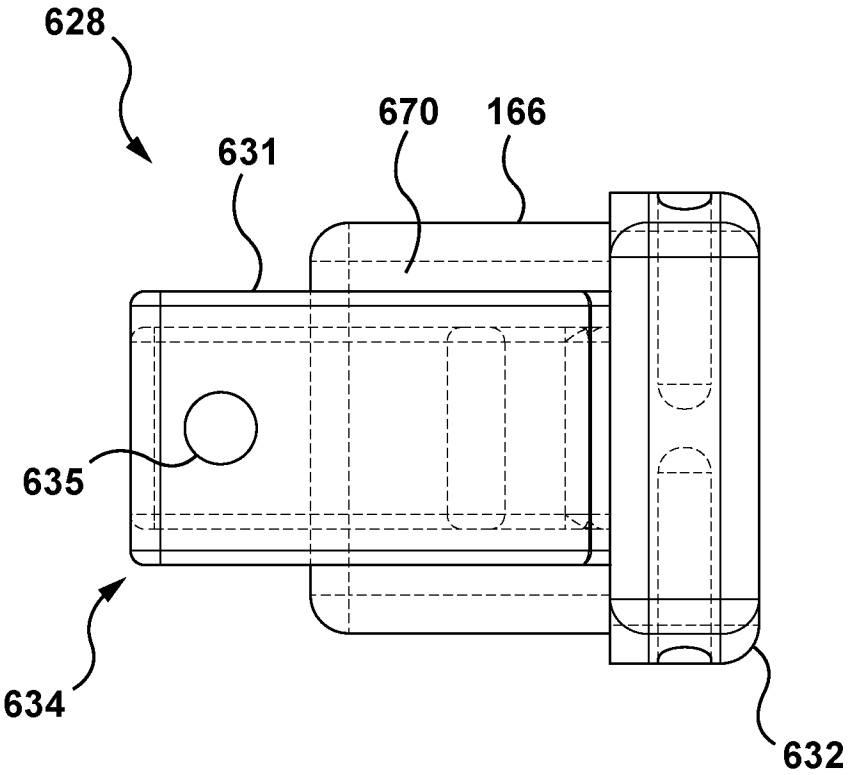
FIG. 6F is a rear elevation view of the end shoe of FIG. 6A.
Figure 6E:
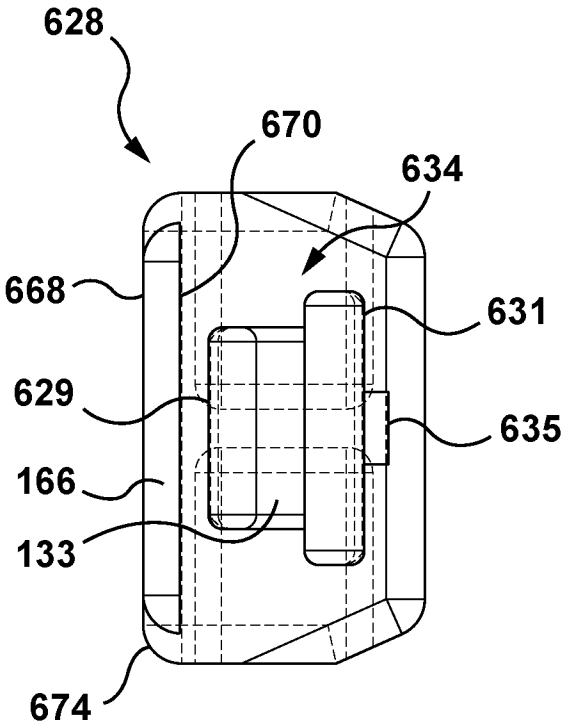
FIG. 6E is a right side elevation view of the end shoe of FIG. 6A.
Figure 6G:
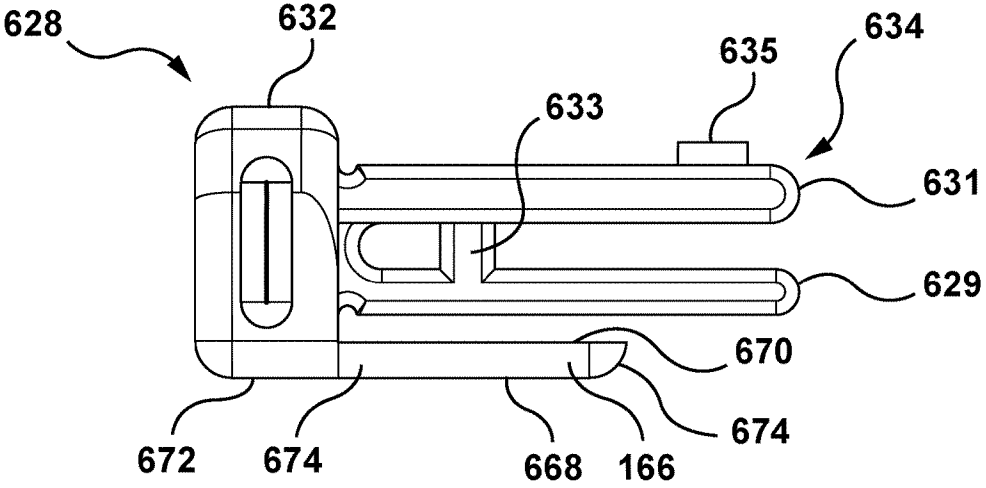
FIG. 6G is a top plan view of the end shoe of FIG. 6A.
Figure 6H:
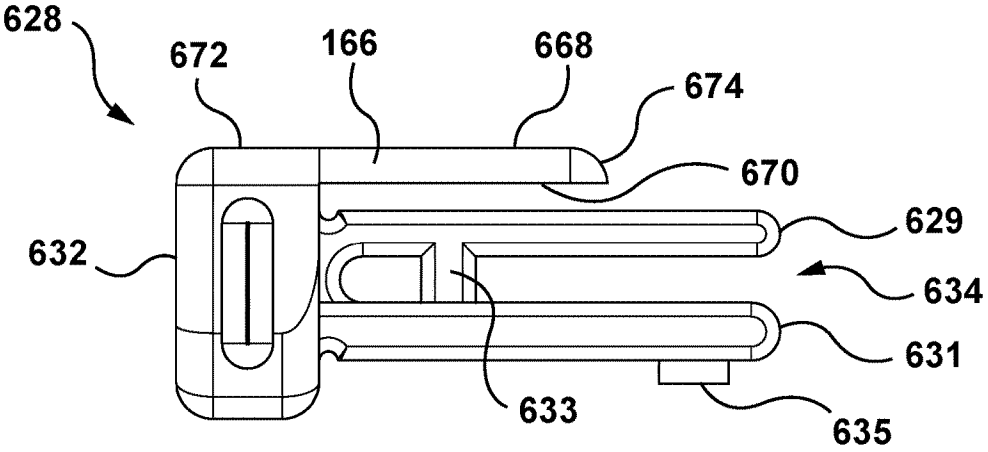
FIG. 6H is a bottom plan view of the end shoe of FIG. 6A.
Figure 7B:
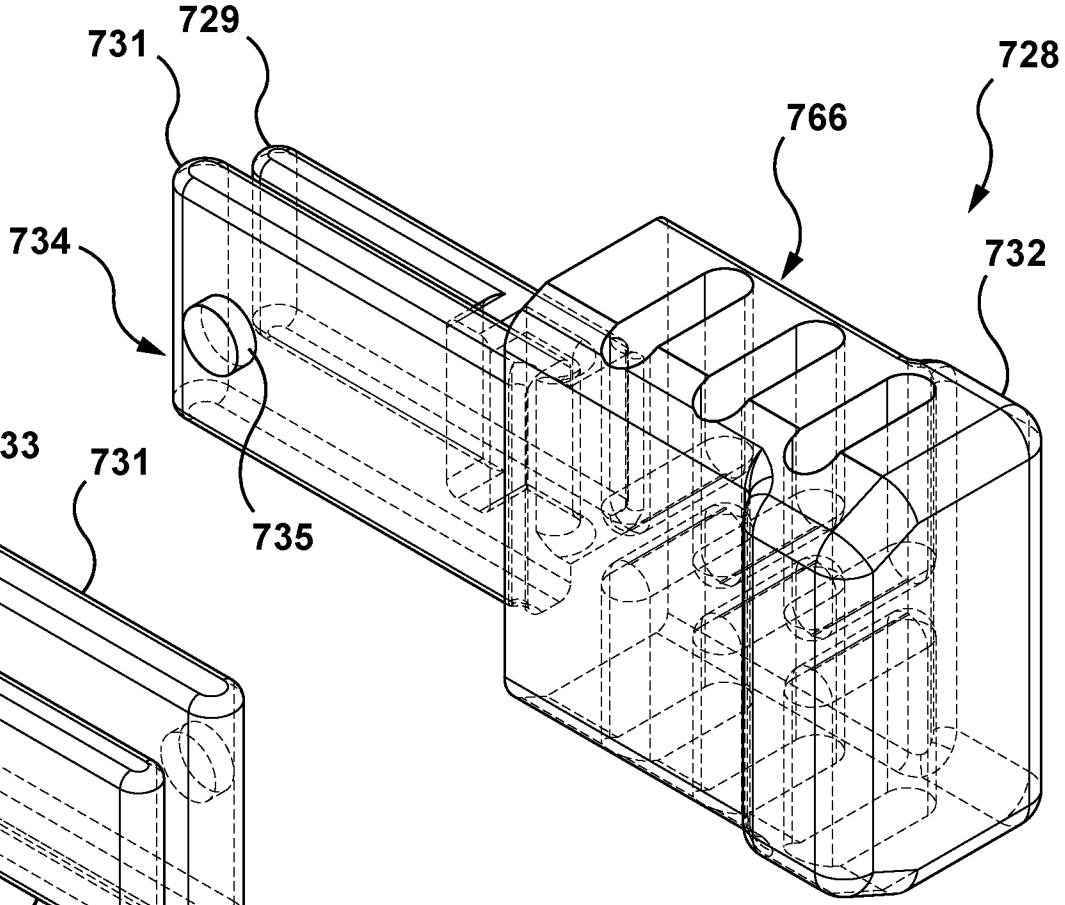
FIG. 7B is a top rear perspective view of the end shoe of FIG. 7A.
Figure 7A:
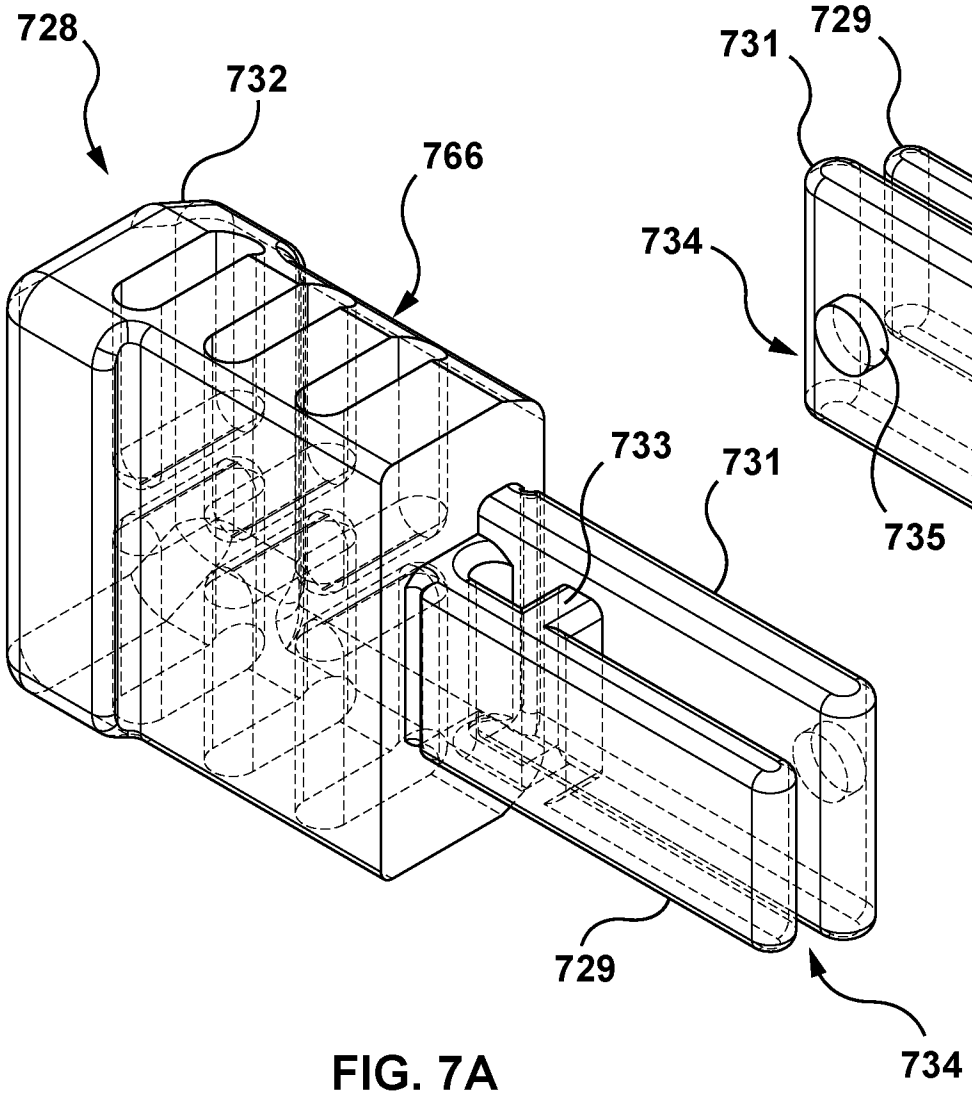
FIG. 7A is a top front perspective view of a third exemplary end shoe according to an aspect of the present disclosure.
Figure 7D:
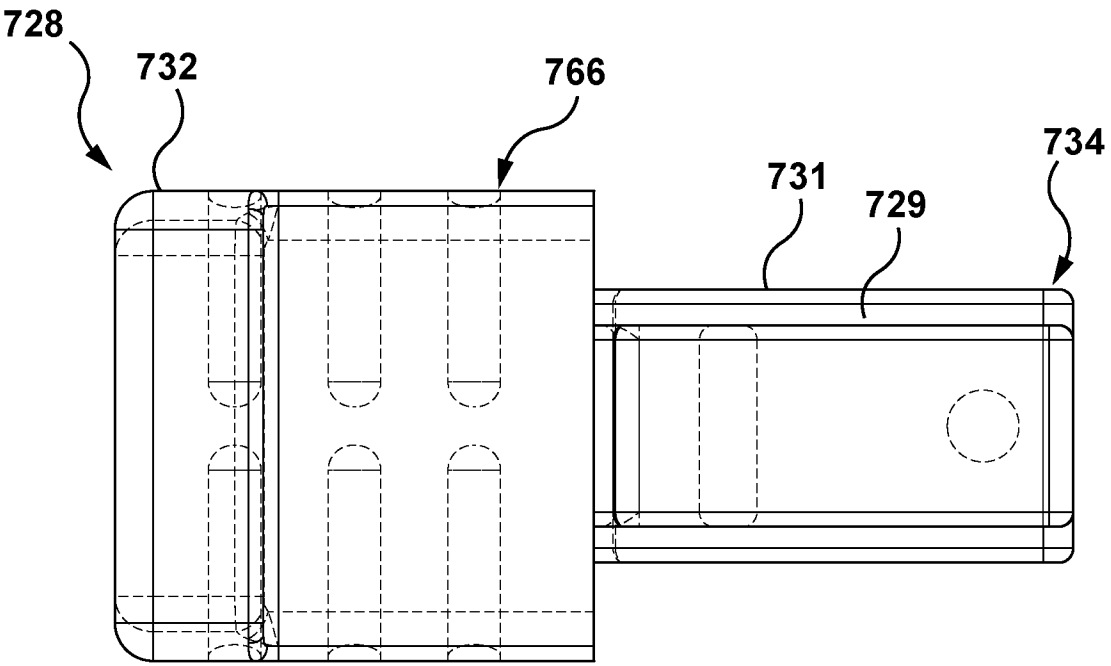
FIG. 7D is a front elevation view of the end shoe of FIG. 7A.
Figure 7C:
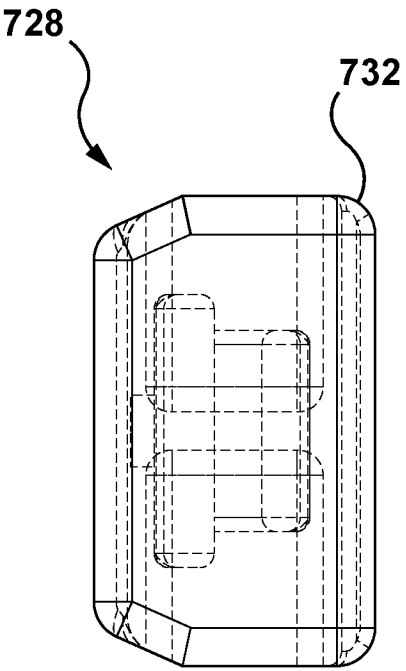
FIG. 7C is a left side elevation view of the end shoe of FIG. 7A.
Figure 7F:
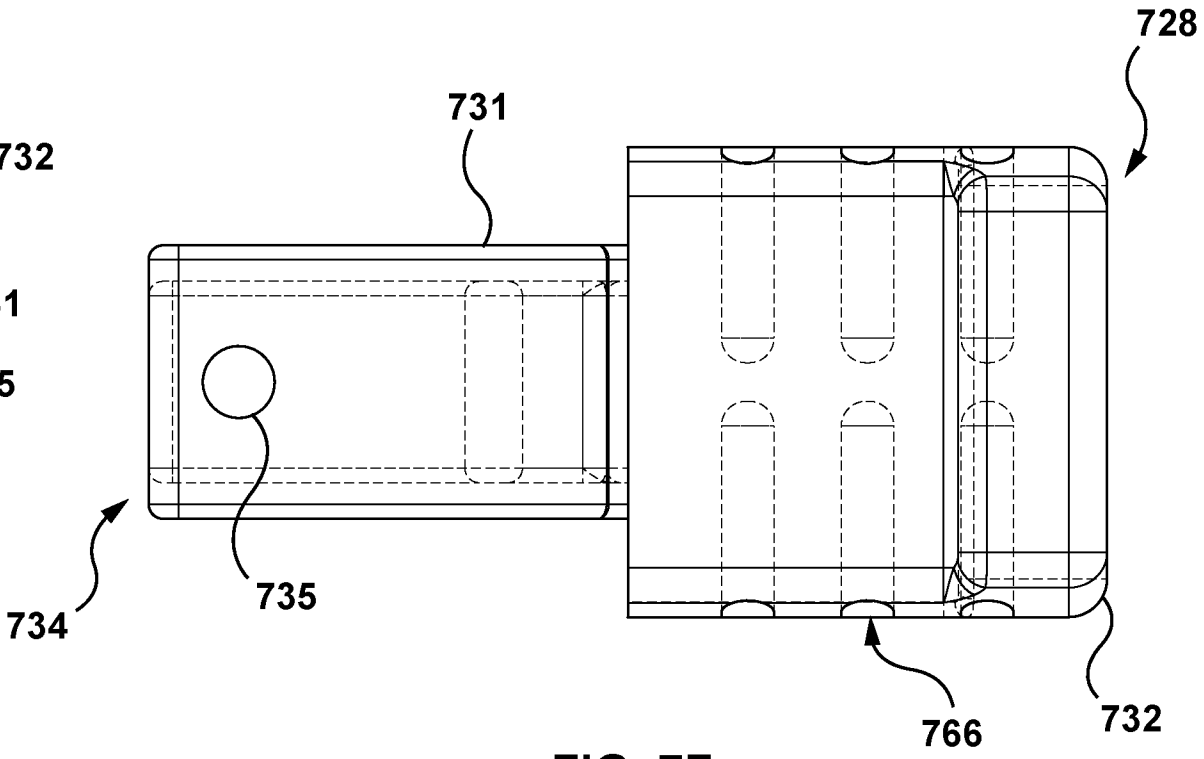
FIG. 7F is a rear elevation view of the end shoe of FIG. 7A.
Figure 7E:
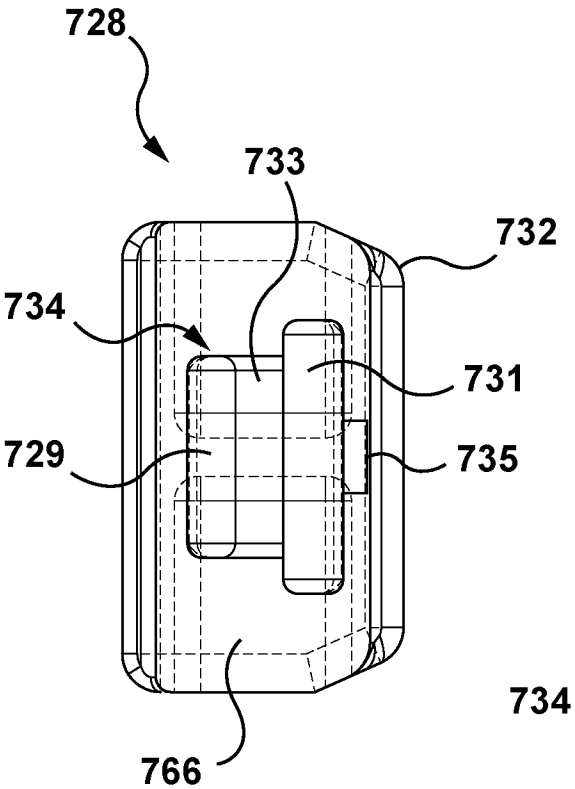
FIG. 7E is a right side elevation view of the end shoe of FIG. 7A.
Figure 7G:
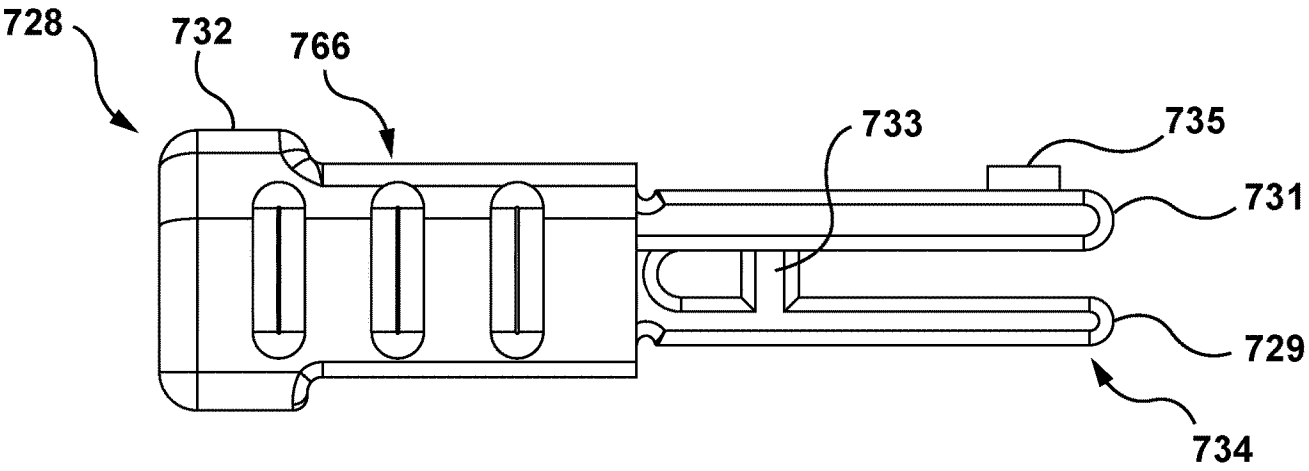
FIG. 7G is a top plan view of the end shoe of FIG. 7A.
Figure 7H:
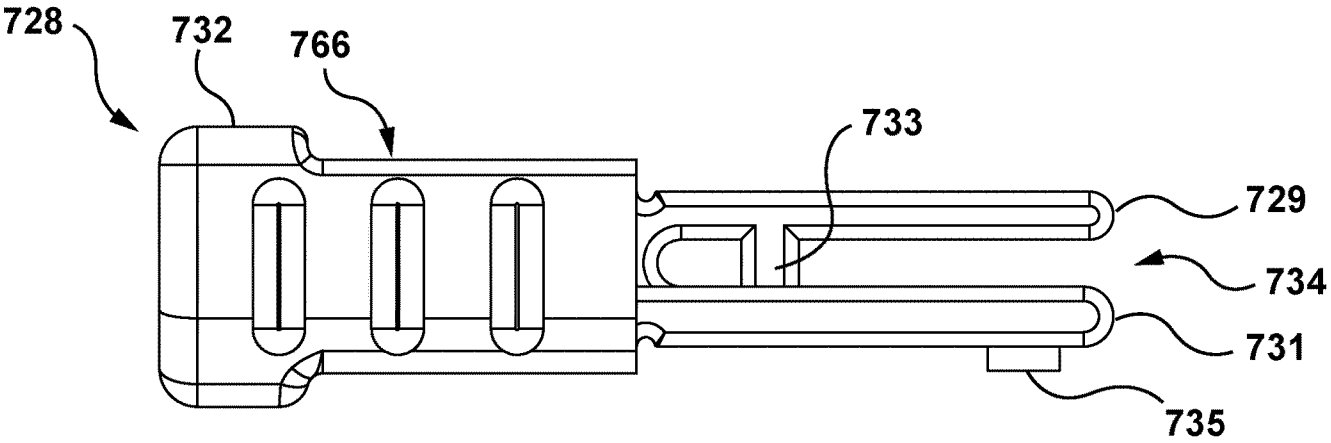
FIG. 7H is a bottom plan view of the end shoe of FIG. 7A.

Returning now to FIG. 1 and also referring to FIGS. 3 and 3A, the retraction roller 106 is carried by the frame 102 so as to be rotatable relative to the frame 102 about an axis of rotation AR that is substantially longitudinally parallel to the door slats 112. The superior end 138 of the roller-shutter door 104 is coupled to the retraction roller 106 by mountings 140. The roller-shutter door 104 can be opened by rolling it onto the retraction roller 106 with rotation of the retraction roller 106 in a first direction R1 and can be closed by unrolling it from the retraction roller 106 with rotation of the retraction roller 106 in a second direction R2 opposite the first direction R1. As best seen in FIGS. 3A and 4B, the longitudinal ends of the door slats 112 (in the illustrated embodiment, the caps 132 of the end shoes 128) are received within and ride along door guide channels 142 in the guide rails 110 as the roller-shutter door 104 is raised and lowered. In the illustrated embodiments, the end shoes 128 are formed of a material (e.g. a suitable plastic) having sufficiently low friction to ride freely in the door guide channels 142, which are slightly larger in dimension; in other embodiments the end shoes and/or door guide channels may be provided with bearings to reduce friction.

Referring specifically to FIG. 4B, a pair of exterior side seals 150 is carried by the frame 102 so as to extend along the guide rails 110. The exterior side seals 150 project from the guide rails 110 and the longitudinal ends of the door slats 112 to cover a gap 152 between the door slats 112 and the door guide channels 142. In the illustrated embodiment, as seen in FIGS. 4 and 4A, each of the exterior side seals 150 is formed from a suitable resilient material and comprises a door engagement portion 154, an anchor 156 and a spacer 158 coupling the sealing portion 154 to the anchor 156. The door engagement portion 154 is of generally Y-shaped cross-section, and the anchor 156 comprises an anchor head 158 that can be releasably received in an anchor channel 160 formed in the respective guide rail 110 to secure the exterior side seal 150 to the guide rail 110. This is merely one exemplary configuration for an external side seal, and other configurations are also contemplated.

At least the exterior-facing portion of the main body member 122 of each door slat 112 is coated, for example by way of painting, anodizing, powder coating, etc. and hence each door slat 112 has a coated exterior surface 162. If the door engagement portions 154 of the exterior side seals 150 were to bear directly against the coated exterior surface 162, the exterior side seals 150 would, over time, cause wear on the coating as the roller-shutter door 104 was opened and closed. To inhibit such wear, as shown in FIGS. 1, 1A and 4 to 4B, each door slat 112 carries a sacrificial wear shield 166 at each longitudinal end thereof. The wear shields 166 are interposed between the coated exterior surfaces 162 of the door slats 112 and the door engagement portions 154 of the exterior side seals 150. As a result of this interposition, the exterior side seals 150 bear on the wear shields 166 instead of on the coated exterior surfaces 162 of the door slats 112.

Because it may take up to four weeks after the coating is applied for the coating to fully cure, adhering wear shields directly to the coated exterior surfaces 162 of the door slats 112 would result in manufacturing delays because it would be necessary to wait for the coating to cure. Moreover, such an approach would not facilitate easy replacement of the wear shields once they wore down, since removing them could remove the coating from the coated surface to which they were adhered, defeating their very purpose. Therefore, it is preferable that the wear shields not be adhered to the coated exterior surfaces 162 of the door slats 112, but instead that the wear shields 166 are carried by the end shoes 128. This may be achieved in a number of ways.

Reference is now made to FIGS. 6A to 6H, which show an exemplary end shoe 628 in which a wear shield 166 is formed monolithically as part of the end shoe 632. Aside from the addition of the wear shield 166, the end shoe 628 is similar in structure to the end shoe 128 shown in FIGS. 5A to 5H, with like reference numerals denoting like features except with the prefix "6" instead of "1". Thus, the end shoe 628 includes a cap 632 adapted to ride within the door guide channels 142, with a latching mechanism 634 comprising a bracing arm 629 and a locking arm 631 arranged in spaced, parallel relation and joined by a crossbar 633 located toward the cap 632, with a detent 635 projecting outwardly from the locking arm 631. The exemplary wear shield 166 shown in FIGS. 6A to 6H depends from the cap 632, and has substantially parallel, generally planar outer and inner surfaces 668, 670 which are also substantially parallel to the bracing arm 629 and the locking arm 631. The wear shield 166 is located on the side of the bracing arm 629 opposite to the locking arm 631 and is spaced from the bracing arm 629 so that the wall of the main body member 122 can fit between the wear shield 166 and the bracing arm 629. Thus, the wear shield 166 depends from the cap 632 alongside the latching mechanism 634 in overlapping relation therewith. The outer surface 668 of the wear shield 166 is substantially flush with the exterior-facing surface 672 of the cap 632, and the edges 674 of the wear shield 166 are rounded. Again, the latching mechanism 634 is merely exemplary, and other suitable techniques for securing the end shoes 628 at the longitudinal ends 130 may also be used without departing from the scope of the present disclosure.

Reference is now made to FIGS. 7A to 7H, which show an exemplary end shoe 728 in which a wear shield 766 takes the form of a spacer 766 interposed between a cap 732 and a latching mechanism 734 of the end shoe 728. The end shoe 728 is similar in structure to the end shoe 128 shown in FIGS. 5A to 5H, with like reference numerals denoting like features except with the prefix "7" instead of "1". However, instead of the latching mechanism depending directly from the cap as in the end shoe 128 shown in FIGS. 5A to 5H, for the end shoe 728 shown in FIGS. 7A to 7H, the wear shield 766 depends from the cap 732 and the latching mechanism 734 in turn depends from the wear shield 766. As before, the latching mechanism 734 comprises a spaced-apart, parallel bracing arm 729 and locking arm 731 joined by a crossbar 733, with a detent 735 projecting outwardly from the locking arm 731. The exemplary end shoe 728 would be used with a relatively shorter main body member 122 than for the exemplary end shoe 628, so that when installed the wear shield 766 will be in registration with the door engagement portions 154 of the exterior side seals 150 so that the exterior side seals 150 bear on the wear shields 766 instead of on the coated exterior surfaces 162 of the door slats 112. The latching mechanism 734 shown is merely one exemplary implementation, and other suitable techniques and mechanisms may also be used.

Figure 8B:
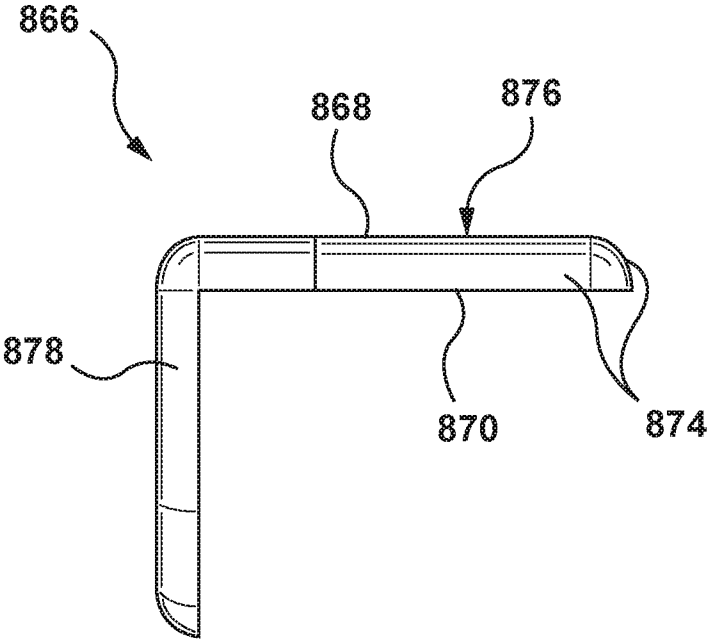
FIG. 8B is a bottom plan view of the wear shield of FIG. 8A.
Figure 8A:
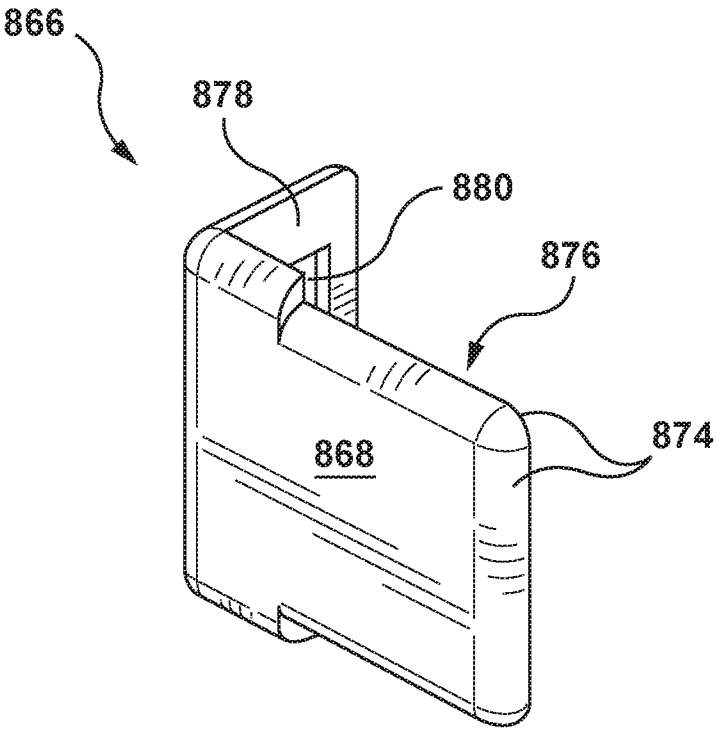
FIG. 8A is a top front perspective view of an exemplary wear shield according to an aspect of the present disclosure.
Figure 9C:
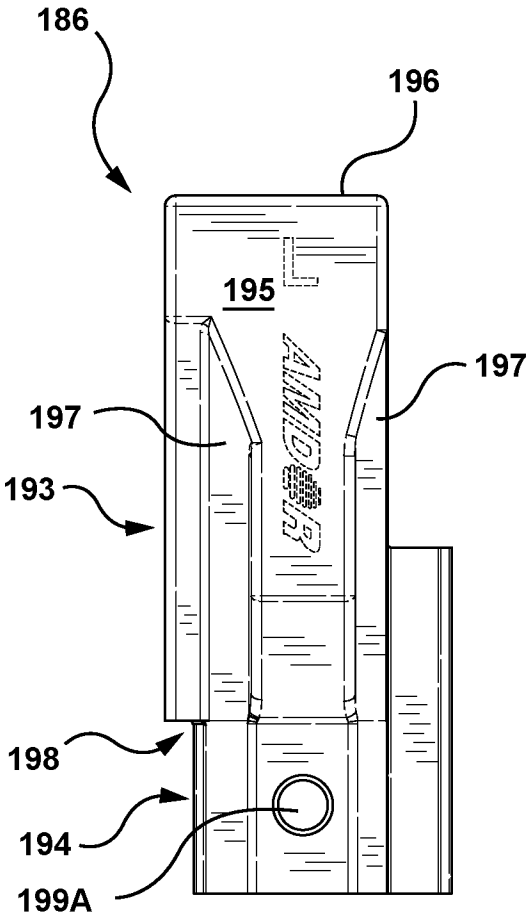
FIG. 9C is a front elevation view of the radius guide of FIG. 9A.
Figure 9B:
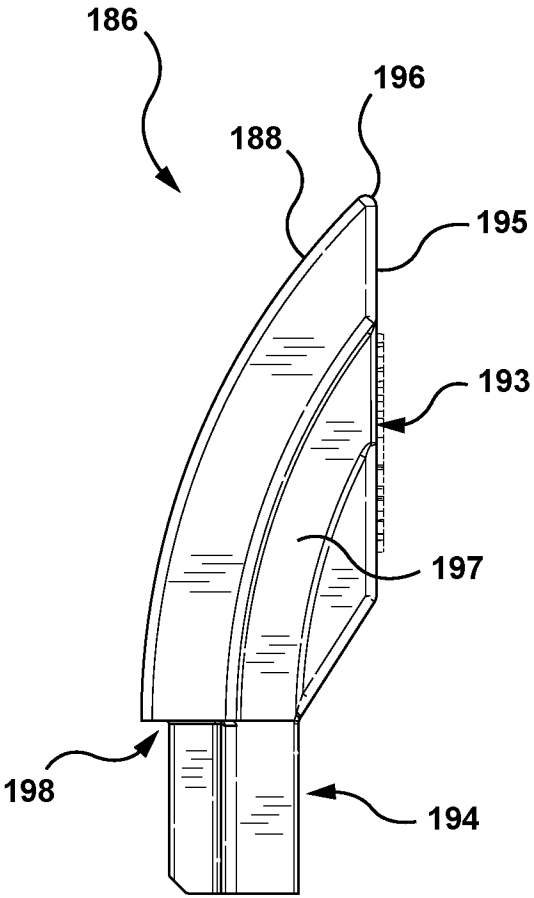
FIG. 9B is a left side elevation view of the radius guide of FIG. 9A.
Figure 9A:
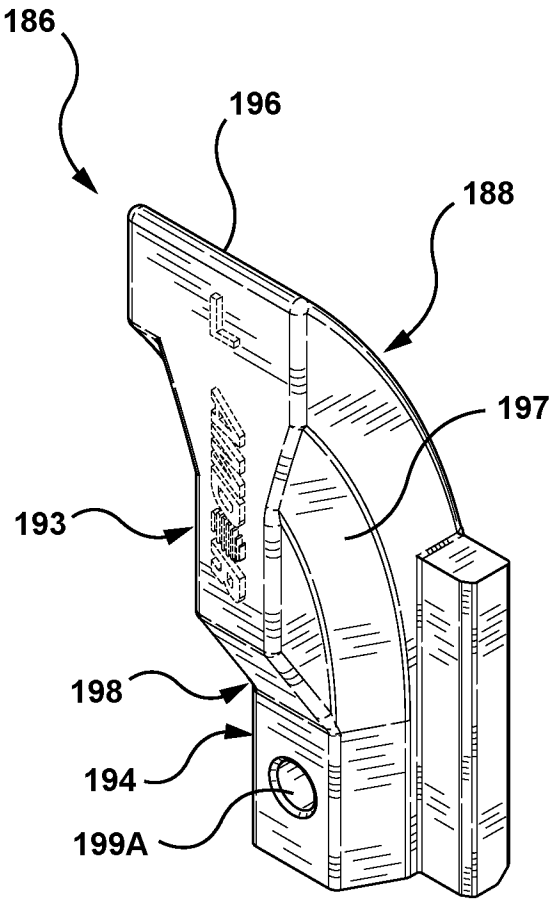
FIG. 9A is a top front perspective view of an exemplary left side radius guide according to an aspect of the present disclosure.
Figure 9F:
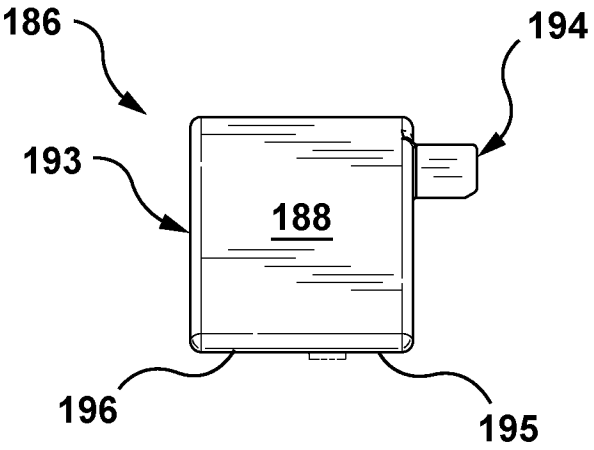
FIG. 9F is a top plan view of the radius guide of FIG. 9A.
Figure 9G:
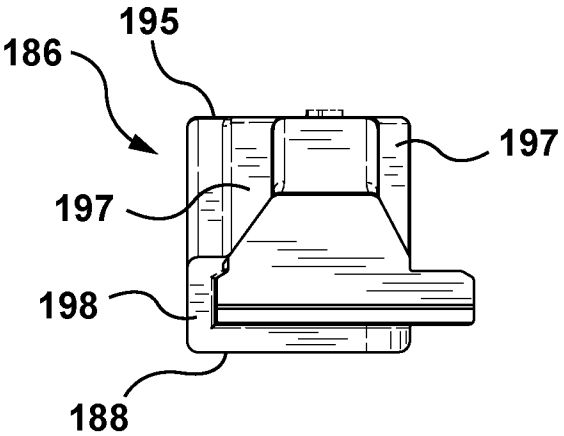
FIG. 9G is a bottom plan view of the radius guide of FIG. 9A.
Figure 9E:
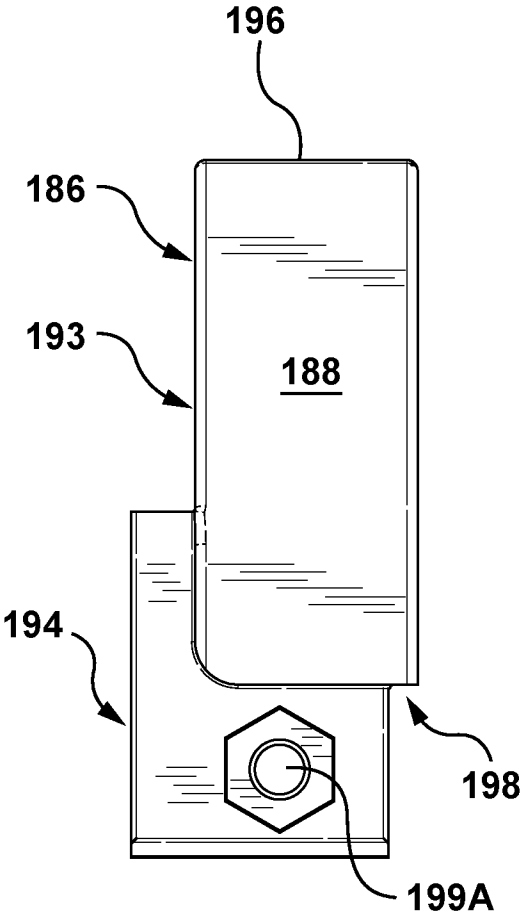
FIG. 9E is a rear elevation view of the radius guide of FIG. 9A.
Figure 9D:
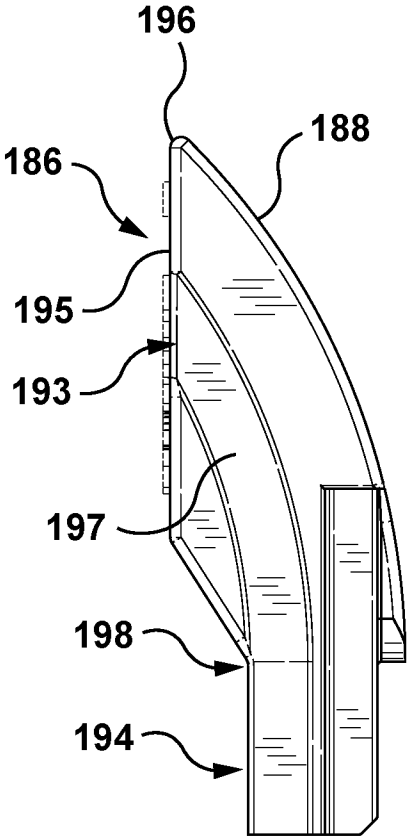
FIG. 9D is a right side elevation view of the radius guide of FIG. 9A.
Figure 10C:
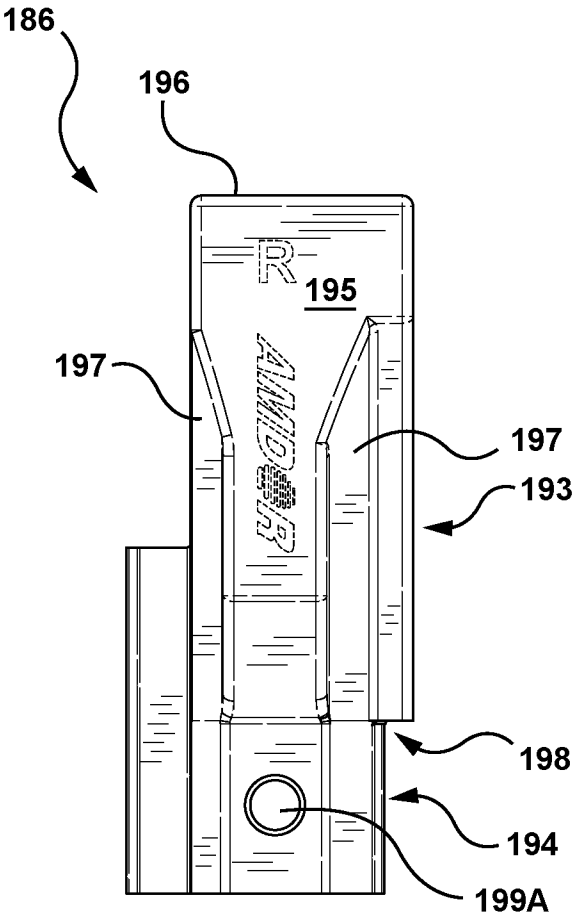
FIG. 10C is a front elevation view of the radius guide of FIG. 10A.
Figure 10B:
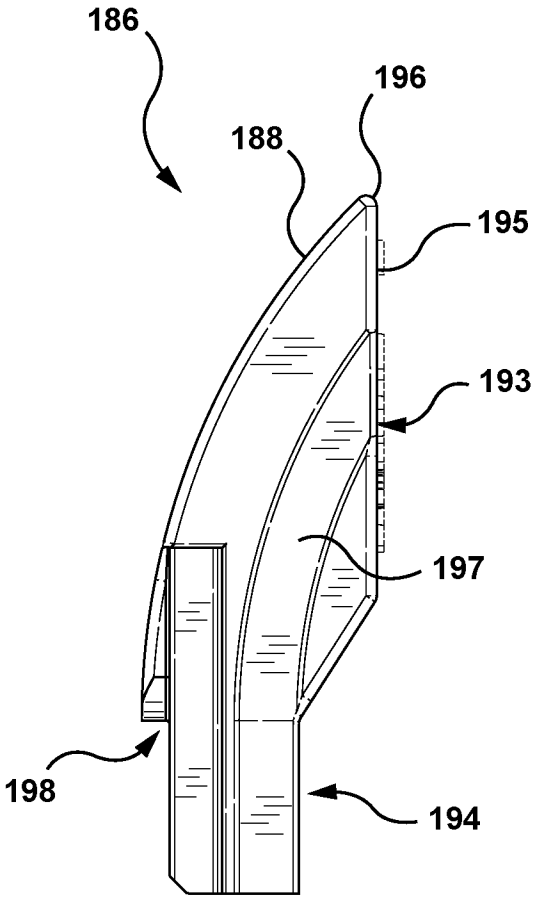
FIG. 10B is a left side elevation view of the radius guide of FIG. 10A.
Figure 10A:
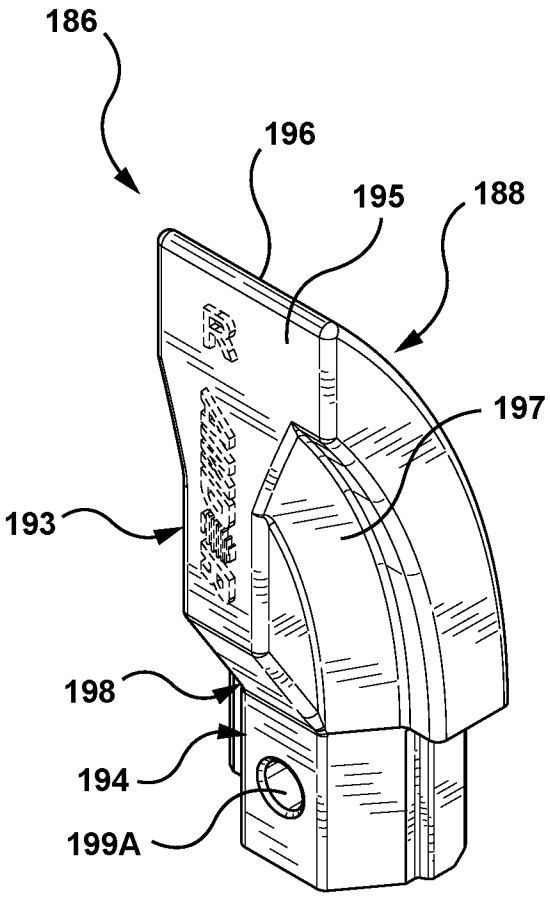
FIG. 10A is a top front perspective view of an exemplary right side radius guide according to an aspect of the present disclosure.
Figure 10F:
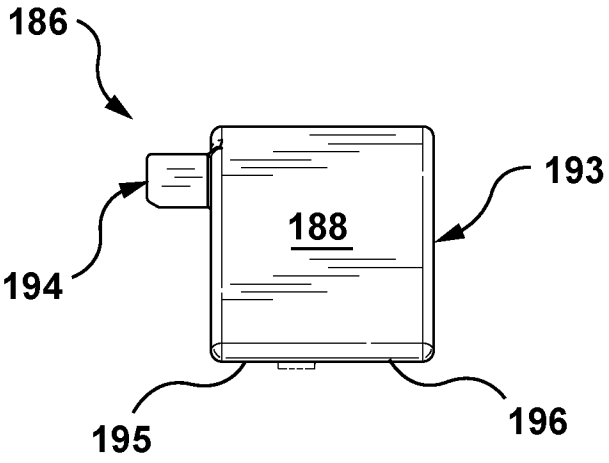
FIG. 10F is a top plan view of the radius guide of FIG. 10A.
Figure 10G:
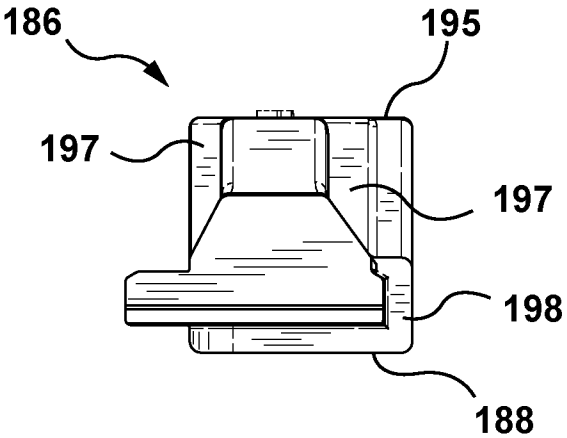
FIG. 10G is a bottom plan view of the radius guide of FIG. 10A.
Figure 10E:
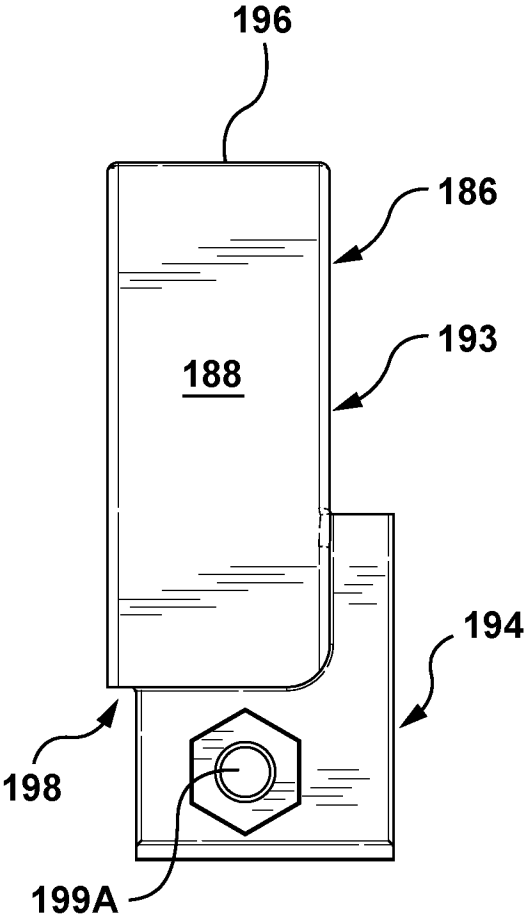
FIG. 10E is a rear elevation view of the radius guide of FIG. 10A.
Figure 10D:
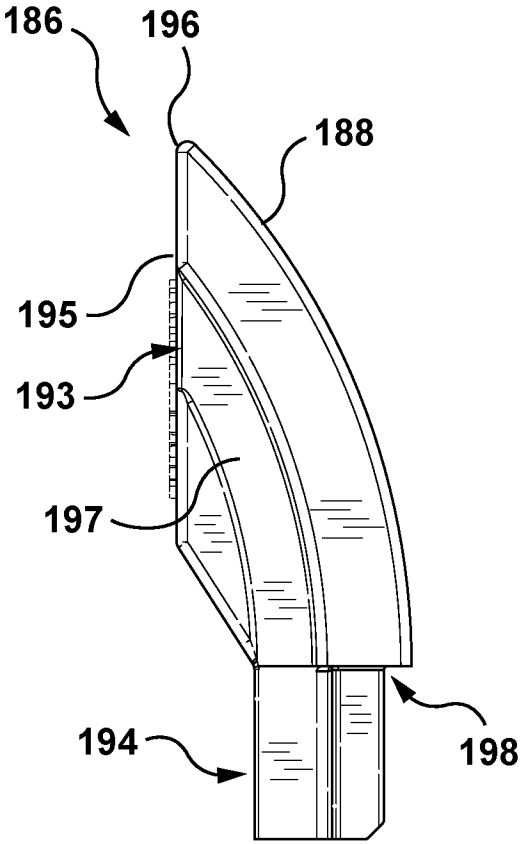
FIG. 10D is a right side elevation view of the radius guide of FIG. 10A.

FIGS. 8A and 8B show a further exemplary implementation of a wear shield, indicated generally by reference 866. Unlike the wear shields 166, 766 described above, exemplary wear shields 866 of the type shown in FIGS. 8A and 8B are separate and distinct parts from the end shoes 128. The exemplary wear shield 866 shown in FIGS. 8A and 8B comprises a plate 876 depending from an annular collar 878 having a collar aperture 880 sized to receive the latching mechanism 134 of the end shoe 128 shown in FIGS. 5A to 5H. The plate 878 is similar to the wear shield 166 shown in FIGS. 6A to 6H, and has substantially parallel, generally planar outer and inner surfaces 868, 870 and rounded edges 874. During installation, the latching mechanism 134 of the end shoe 128 shown in FIGS. 5A to 5H is passed through the collar aperture 880 before insertion into the open end of the main body member so that when the detent 135 snaps into the retaining aperture 137, the annular collar 878, and hence the wear shield 866, is trapped between the end shoe 128 and the main body member 122 forming the door slat 122. In this configuration, when the door slat 122 is integrated into the roller-shutter door system 100, the plate 876 will be in registration with the door engagement portions 154 of the exterior side seals 150, with the inner surface 870 facing the coated exterior surface of the door slat 112. As such, the exterior side seals 150 bear on the outer surface 868 of the wear shield 866 instead of on the coated exterior surface 162 of the door slat 112.

The wear shields described above are merely illustrative examples of wear shields that may be interposed between the coated exterior surfaces of the door slats and the side seals so that the side seals bear on the wear shields instead of on the coated exterior surfaces of the door slats and are not intended to be limiting; other types and configurations of wear shields are also contemplated.

Referring now to FIGS. 3 and 3A, in a preferred embodiment the guide rails 110 have equipment channels 182 disposed on interior sides thereof, relative to the roller-shutter door 114. The equipment channels 182 are substantially parallel to and in longitudinal registration with the door guide channels 142, and are disposed inwardly of the door guide channels 142 relative to the door 104. The equipment channels 182 include opposed inwardly projecting retaining lips 183 (see FIG. 3A) and may receive, for example, lighting arrays and/or door-ajar sensors. Instead of part of the guide rail being cut away and a portion of the guide rail being curved inwardly to provide a guide surface for the door slats 112, the guide rails 110 are configured so that the superior ends 184 of the equipment channels 182 are open and unobstructed by any part of the guide rails 110, and a radius guide 186 is releasably received in the open superior end 184 of each equipment channel 182. The radius guides 186 each have an outwardly facing guide surface 188 that curves inwardly and superiorly, relative guide rail and serve to guide the door slats 112 toward the retraction roller 106. Typically, an idler roller 190 (FIG. 4B) is interposed between the radius guides 186 and the retraction roller 106, which may be driven or free-wheeling. Because the radius guides 186 are removable from the equipment channels 182, field service of equipment in the equipment channels is simplified. Whereas the inwardly curved portion of the guide rail could have obstructed the removal and installation of components from the equipment channel via the superior end thereof, removal of the radius guide 186 from the equipment channel 182 completely opens the superior end 184 thereof to permit withdrawal and insertion of equipment during field service. In some cases, one or more of the components installed in the equipment channel(s) 182 is substantially rigid. For example, FIGS. 3 and 3A show a substantially rigid door-ajar switch 192 disposed in one of the equipment channels 182. In such cases, the vertical clearance VC above the superior end 184 of the respective equipment channel 182 when the radius guide 186 is removed from the superior end 184 of the respective equipment channel 182 preferably exceeds the length LC of the substantially rigid component (e.g. door-ajar switch 192) to permit withdrawal of the component by sliding the component out of the open superior end 184 of the respective equipment channel 182.

FIGS. 9A to 9G and 10A to 10G show one exemplary embodiment of a radius guide 186. FIGS. 9A to 9G show a left side version and FIGS. 10A to 10G show a right side version. The exemplary radius guide 186 comprises a guide portion 193 and a mounting insert 194. The guide portion 193 includes the outwardly facing guide surface 188 as well as a generally planar inner face 195 disposed opposite the outwardly facing guide surface 188, with the outwardly facing guide surface 188 and the generally planar inner face 195 converging at a superior end 196 of the guide portion 193, which is also the superior end of the radius guide 186. Inferiorly of the superior end 196 of the guide portion 193, recessed edges 197 of the guide portion 193 fall away from the inner face 195. The mounting insert 194 depends from an inferior end 198 of the guide portion 193, and is adapted to fit snugly into the superior end 184 of the equipment channel 182 so as to be trapped by the retaining lips 183. A countersunk aperture 199A in the mounting insert 194 can receive a locknut which in turn can receive a setscrew 199B (FIG. 3A) for securing the mounting insert 195 at the superior end 184 of the equipment channel 182. The radius guide 186 shown in FIGS. 9A to 9F is a left side radius guide, a right side radius guide may be a mirror image thereof.

While the exemplary roller-shutter door system 100 shown and described herein includes both wear shields and removable radius guides, other embodiments may include only wear shields or only removable radius guides without departing from the scope of the present disclosure.

Certain embodiments have been described by way of example. It will be apparent to persons skilled in the art that a number of variations and modifications can be made without departing from the scope of the claims.

In memory of patent illustrator and artist Paul Dorsett (1949 to 2017).

What is claimed is:

1. A roller-shutter door system, comprising:
a frame;
the frame including a pair of opposed substantially parallel guide rails;
a roller-shutter door, comprising:
a plurality of door slats having coated exterior surfaces;
the door slats being longitudinally hingedly coupled to one another to form the roller-shutter door; and
a retraction roller carried by the frame so as to be rotatable relative to the frame about an axis of rotation substantially longitudinally parallel to the door slats;
a superior end of the roller-shutter door being coupled to the retraction roller whereby the roller-shutter door can be opened by rolling onto the retraction roller with rotation of the retraction roller in a first direction and closed by unrolling from the retraction roller with rotation of the retraction roller in a second direction opposite the first direction;
wherein longitudinal ends of the door slats are received within and are configured to ride along door guide channels in the guide rails;
a pair of exterior side seals carried by the frame and extending along the guide rails, each of the side seals projecting from the respective guide rail towards the respective longitudinal end of the respective door slat to cover a respective gap between the respective door slat and the respective door guide channel when the roller-shutter door is closed;
wherein:
the side seals are resilient;
each door slat carries a replaceable sacrificial wear shield at each longitudinal end thereof;
the wear shields being interposed between the coated exterior surfaces of the door slats and the side seals whereby the side seals are configured to bear on the wear shields instead of on the coated exterior surfaces of the door slats.

2. The roller-shutter door system of claim 1, wherein:
the door slats comprise:
hollow main body members having open ends; and
end shoes secured inside the open ends of the main body members whereby the end shoes form the longitudinal ends of the door slats;
and wherein the wear shields are carried by the end shoes.

3. The roller-shutter door system of claim 2, wherein the wear shields are projections formed monolithically as part of the end shoes.

4. The roller shutter door system of claim 3, wherein:
the end shoes each comprise:
a cap; and
a releasable latching mechanism depending from the cap;
the end shoes being releasably received within a respective one of the open ends of the respective main body member; and
each wear shield is a spacer interposed between the cap and the latching mechanism.

5. The roller-shutter door system of claim 1, wherein:
the guide rails have equipment channels disposed on interior sides thereof, relative to the roller-shutter door;
a superior end of each equipment channel is open and a radius guide is releasably received in the superior end of each equipment channel; and
each radius guide having an outwardly facing guide surface that curves inwardly and superiorly to guide the door slats toward the retraction roller.

6. The roller-shutter door system of claim 5, wherein:
at least one substantially rigid component is disposed in at least one of the equipment channels; and
a vertical clearance above the superior end of the respective equipment channel when the radius guide is removed from the superior end of the respective equipment channel exceeds a length of the at least one substantially rigid component to permit withdrawal of the at least one substantially rigid component by sliding the at least one substantially rigid component out of the superior end of the respective equipment channel.

7. The roller-shutter door system of claim 1, wherein the coated exterior surfaces are painted surfaces.

8. The roller-shutter door system of claim 1, wherein the coated exterior surfaces are anodized surfaces.

9. The roller-shutter door system of claim 1, wherein the coated exterior surfaces are powder coated surfaces.

10. A roller-shutter door system, comprising:
a frame;
the frame including a pair of opposed substantially parallel guide rails;
a roller-shutter door, comprising:
a plurality of door slats;
the door slats being longitudinally hingedly coupled to one another to form the roller-shutter door; and
a retraction roller carried by the frame so as to be rotatable relative to the frame about an axis of rotation substantially longitudinally parallel to the door slats;
a superior end of the roller-shutter door being coupled to the retraction roller whereby the roller-shutter door can be opened by rolling onto the retraction roller with rotation of the retraction roller in a first direction and closed by unrolling from the retraction roller with rotation of the retraction roller in a second direction opposite the first direction;
wherein longitudinal ends of the door slats are received within and are configured to ride along door guide channels in the guide rails;
wherein the guide rails have equipment channels disposed on interior sides thereof, relative to the roller-shutter door;
wherein the guide rails are configured so that superior ends of the equipment channels are open and unobstructed by any part of the guide rails; and wherein a radius guide is releasably received in the superior end of each equipment channel;

each radius guide having an outwardly facing guide surface that curves inwardly and superiorly relative to the guide rails to guide the door slats toward the retraction roller;

at least one substantially rigid component is disposed in at least one of the equipment channels; and a vertical clearance above the superior end of the respective equipment channel exceeds a length of the at least one substantially rigid component;

whereby:

when the radius guide is received in the superior end of the respective equipment channel, the radius guide obstructs withdrawal of the at least one substantially rigid component out of the superior end of the respective equipment channel by obstructing the superior end of the respective equipment channel; and when the radius guide is removed from the superior end of the respective equipment channel, withdrawal of the at least one substantially rigid component by sliding the at least one substantially rigid component out of the superior end of the respective equipment channel is permitted.

11. A roller-shutter door system, comprising:

a frame;

the frame including a pair of opposed substantially parallel guide rails;

a roller-shutter door, comprising:

a plurality of door slats having coated exterior surfaces;

the door slats being longitudinally hingedly coupled to one another to form the roller-shutter door;

the door slats comprising:

main body members; and end shoes secured at longitudinal ends of the main body members whereby the end shoes form longitudinal ends of the door slats; and a retraction roller carried by the frame so as to be rotatable relative to the frame about an axis of rotation substantially longitudinally parallel to the door slats;

a superior end of the roller-shutter door being coupled to the retraction roller whereby the roller-shutter door can be opened by rolling onto the retraction roller with rotation of the retraction roller in a first direction and closed by unrolling from the retraction roller with rotation of the retraction roller in a second direction opposite the first direction;

wherein the longitudinal ends of the door slats are received within and are configured to ride along door guide channels in the guide rails;

a pair of exterior side seals carried by the frame and extending along the guide rails, each of the side seals projecting from the respective guide rail towards the respective longitudinal end of the respective door slat to cover a respective gap between the respective door slat and the respective door guide channel when the roller-shutter door is closed;

the guide rails have equipment channels disposed on interior sides thereof, relative to the roller-shutter door;

the equipment channels being substantially parallel to and in longitudinal registration with the door guide channels and being disposed inwardly of the door guide channels relative to the door;

wherein:

each door slat carries a sacrificial wear shield at each longitudinal end thereof;

the wear shields being interposed between the coated exterior surfaces of the door slats and the side seals whereby the side seals are configured to bear on the wear shields instead of on the coated exterior surfaces of the door slats; and the wear shields are carried by the end shoes;

and wherein:

the guide rails are configured so that superior ends of the equipment channels are open and unobstructed by any part of the guide rails; and a radius guide is releasably received in the superior end of each equipment channel;

each radius guide having an outwardly facing guide surface that curves inwardly and superiorly relative to the guide rails to guide the door slats toward the retraction roller;

at least one substantially rigid component is disposed in at least one of the equipment channels; and a vertical clearance above the superior end of the respective equipment channel exceeds a length of the at least one substantially rigid component;

whereby:

when the radius guide is received in the superior end of the respective equipment channel, the radius guide obstructs withdrawal of the at least one substantially rigid component out of the superior end of the respective equipment channel by obstructing the superior end of the respective equipment channel; and when the radius guide is removed from the superior end of the respective equipment channel, withdrawal of the at least one substantially rigid component by sliding the at least one substantially rigid component out of the superior end of the respective equipment channel is permitted.

12. The roller-shutter door system of claim 11, wherein the wear shields are projections formed monolithically as part of the end shoes.

13. The roller shutter door system of claim 12, wherein:

the end shoes each comprise:

a cap; and a releasable latching mechanism depending from the cap; and each wear shield is a spacer interposed between the cap and the latching mechanism.

14. The roller-shutter door system of claim 11, wherein the coated exterior surfaces are painted surfaces.

15. The roller-shutter door system of claim 11, wherein the coated exterior surfaces are anodized surfaces.

16. The roller-shutter door system of claim 11, wherein the coated exterior surfaces are powder coated surfaces.

* * * * *